US010316865B2

(12) United States Patent
Yokoyama et al.

(10) Patent No.: US 10,316,865 B2
(45) Date of Patent: Jun. 11, 2019

(54) EJECTOR, MANUFACTURING METHOD THEREOF, AND EJECTOR-TYPE REFRIGERATION CYCLE

(71) Applicant: DENSO CORPORATION, Kariya, Aichi-pref. (JP)

(72) Inventors: Yoshiyuki Yokoyama, Kariya (JP); Haruyuki Nishijima, Kariya (JP); Etsuhisa Yamada, Kariya (JP); Ryota Nakashima, Kariya (JP); Yoshiaki Takano, Kariya (JP); Kazunori Mizutori, Kariya (JP); Yorito Kohara, Kariya (JP); Hiroshi Shintani, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/556,486

(22) PCT Filed: Mar. 2, 2016

(86) PCT No.: PCT/JP2016/001114
§ 371 (c)(1),
(2) Date: Sep. 7, 2017

(87) PCT Pub. No.: WO2016/143300
PCT Pub. Date: Sep. 15, 2016

(65) Prior Publication Data

US 2018/0045225 A1 Feb. 15, 2018

(30) Foreign Application Priority Data

Mar. 9, 2015 (JP) ..... 2015-045870
Feb. 8, 2016 (JP) ..... 2016-022118

(51) Int. Cl.
*F04F 5/04* (2006.01)
*F04F 5/46* (2006.01)
*F25B 41/00* (2006.01)

(52) U.S. Cl.
CPC ..... *F04F 5/463* (2013.01); *F04F 5/04* (2013.01); *F04F 5/46* (2013.01); *F25B 41/00* (2013.01);
(Continued)

(58) Field of Classification Search
CPC ..... F04F 5/463; F04F 5/04; F04F 5/46; F25B 41/00; F25B 2341/0012
See application file for complete search history.

(56) References Cited

U.S. PATENT DOCUMENTS

2009/0229304 A1 9/2009 Ogata et al.
2014/0020424 A1 1/2014 Suzuki et al.
(Continued)

FOREIGN PATENT DOCUMENTS

JP H1137577 A 2/1999
JP 2009221883 A 10/2009
(Continued)

*Primary Examiner* — Ana M Vazquez
(74) *Attorney, Agent, or Firm* — Harness, Dickey & Pierce, P.L.C.

(57) ABSTRACT

An ejector has a nozzle, a body, a passage defining member and a drive portion. The body has a refrigerant suction port and a pressure increasing portion. A nozzle passage is defined between an inner surface of the nozzle and an outer surface of the passage defining member and has a minimum sectional area portion, a tapered portion, and an expansion portion. The minimum sectional area portion has a smallest passage sectional area. The tapered portion is located upstream of the minimum sectional area portion in a refrigerant flow direction and has a passage sectional area decreasing toward the minimum sectional area portion gradually. The expansion portion is located downstream of
(Continued)

the minimum sectional area portion in the refrigerant flow direction and has a passage sectional area increasing gradually. The passage defining member has a groove that is recessed to increase the passage sectional area of the nozzle passage.

11 Claims, 9 Drawing Sheets

(52) U.S. Cl.
CPC . *F25B 2341/001* (2013.01); *F25B 2341/0012* (2013.01)

(56) References Cited

U.S. PATENT DOCUMENTS

| | | | | |
|---|---|---|---|---|
| 2015/0023809 | A1 | 1/2015 | Yamada et al. | |
| 2015/0033790 | A1* | 2/2015 | Yamada ..... | F04F 5/462 62/500 |
| 2016/0047586 | A1 | 2/2016 | Kayano et al. | |

FOREIGN PATENT DOCUMENTS

| | | | |
|---|---|---|---|
| JP | 2012202653 | A | 10/2012 |
| JP | 2013177879 | A | 9/2013 |
| JP | 2013185485 | A | 9/2013 |
| JP | 2014190229 | A | 10/2014 |

* cited by examiner

INTERMEDIATE LOAD OPERATION - HIGH LOAD OPERATION

LOW LOAD OPERATION

LOW LOAD OPERATION

LOW LOAD OPERATION

EJECTOR, MANUFACTURING METHOD THEREOF, AND EJECTOR-TYPE REFRIGERATION CYCLE

CROSS REFERENCE TO RELATED APPLICATIONS

This application is a U.S. National Phase Application under 35 U.S.C. 371 of International Application No. PCT/JP2016/001114 filed on Mar. 2, 2016 and published in Japanese as WO 2016/143300 A1 on Sep. 15, 2016. This application is based on and claims the benefit of priority from Japanese Patent Application No. 2015-045870 filed on Mar. 9, 2015 and Japanese Patent Application No. 2016-022118 filed on Feb. 8, 2016. The entire disclosures of all of the above applications are incorporated herein by reference.

TECHNICAL FIELD

The present disclosure relates to an ejector, a manufacturing method thereof, and an ejector-type refrigeration cycle. The ejector draws a fluid using suction force of an injected fluid injected at a high speed.

BACKGROUND ART

Patent Literature 1 discloses an ejector and an ejector-type refrigeration cycle. The ejector has a refrigerant suction port that draws a refrigerant as a suction refrigerant by using suction force of an injection refrigerant injected at a high speed. The ejector mixes the injection refrigerant and the suction refrigerant to be a mixed refrigerant and increases a pressure of the mixed refrigerant. The ejector-type refrigeration cycle is a vapor compression refrigeration cycle device having the ejector as a refrigerant pressure reducer.

The ejector of the Patent Literature 1 has a body that houses a passage defining member having a truncated cone shape. A refrigerant passage is defined between the body and a side surface of the passage defining member. The refrigerant passage has an annular shape in a cross section. The refrigerant passage has a most-upstream portion and a most-downstream portion in a refrigerant flow direction. The most-upstream portion serves as a nozzle passage that reduces a pressure of a high-pressure refrigerant and then injects the decompressed refrigerant. The most-downstream portion serves as a diffuser passage. The diffuser passage mixes the injection refrigerant and the suction refrigerant and increases the pressure of the mixed refrigerant.

The body of the ejector disclosed in Patent Literature 1 has a swirl space therein. The swirl space is a swirl flow generator that causes a swirl flow in the refrigerant flowing into the nozzle passage. Specifically, a subcooled liquid-phase refrigerant swirls in the swirl space such that a refrigerant around a swirl center is decompression-boiled. As a result, a gas-liquid two phase refrigerant, in which a gas-phase refrigerant is concentrated around the swirl center, flows into the nozzle passage.

Thus, it is an objective of Patent Literature 1 to promote the refrigerant to boil in the nozzle passage and thereby improving energy conversion efficiency when converting pressure energy of the refrigerant into kinetic energy in the nozzle passage.

PRIOR ART LITERATURES

Patent Literature

Patent Literature 1: JP 2013-177879 A

SUMMARY OF INVENTION

According to studies conducted by the inventors of the present disclosure, the ejector of Patent Literature 1 has a refrigerant inflow passage that guides the refrigerant into the swirl passage, and a shape of the refrigerant inflow passage and a shape of the swirl space are fixed. Accordingly, a volume of the refrigerant flowing into the swirl space changes when a volume of the refrigerant circulating in the ejector-type refrigeration cycle changes due to a load change caused in the ejector-type refrigeration cycle.

According to Patent Literature 1, although the ejector can cause the refrigerant to be the gas-liquid two phase refrigerant, which is an appropriate state of the refrigerant to improve the energy conversion efficiency, in the swirl space, the ejector may not be able to guide the gas-liquid two phase refrigerant into the nozzle passage.

For example, it is considered to set dimensions of the swirl space such that the gas-liquid two phase refrigerant flows into the nozzle passage in a high load operation in which the volume of the refrigerant circulating in the refrigeration cycle is large. In this case, a swirl speed of the refrigerant decreases and thereby the refrigerant cannot be decompression boiled in a low load operation in which the volume of the refrigerant circulating in the refrigeration cycle is small.

Then, it is considered to set the dimensions of the swirl space such that the gas-liquid two phase refrigerant flows into the nozzle passage in the low load operation. In this case, the swirl speed increases excessively and thereby a volume of the gas-phase refrigerant generated by the decompression boiling increases excessively in the high load operation. As a result, a pressure loss of the gas-liquid two phase refrigerant passing through the nozzle passage increases.

That is, the gas-liquid two phase refrigerant may not flow into the nozzle passage when the load change occurs in the refrigeration cycle device, and thereby the energy conversion efficiency of the ejector may deteriorate.

The present disclosure addresses the above-described issues, and it is a first objective of the present disclosure to provide an ejector for a refrigeration cycle device, the ejector that can secure great energy conversion efficiency regardless of a load change occurring in the refrigeration cycle device.

It is a second objective of the present disclosure to provide a manufacturing method for the ejector that can secure great energy conversion efficiency regardless of a load change occurring in the refrigeration cycle device.

It is a third objective of the present disclosure to provide an ejector-type refrigeration cycle having the ejector that can secure great energy conversion efficiency regardless of a load change occurring in the refrigeration cycle device.

The present disclosure discloses a unique technique that promotes a refrigerant to boil while passing through a nozzle passage regardless of a load change occurring in the refrigeration cycle device.

An ejector of the present disclosure is disposed in a vapor compression refrigeration cycle device.

According to a first aspect of the present disclosure, the ejector has a body, a passage defining member, and a drive portion.

The body has a refrigerant suction port and a pressure increasing portion. The refrigerant suction port draws a refrigerant, as a suction refrigerant, from outside using a suction force of the injection refrigerant jetting out of the nozzle. The pressure increasing portion mixes the injection refrigerant and the suction refrigerant to be a mixed refrigerant and increases a pressure of the mixed refrigerant.

The passage defining member is located in a refrigerant passage that is defined in the nozzle. The drive portion moves the passage defining member.

The refrigerant passage has a nozzle passage defined between an inner surface of the nozzle and an outer surface of the passage defining member. The nozzle passage has a minimum sectional area portion, a tapered portion, and an expansion portion. The minimum sectional area portion has a smallest passage sectional area in the nozzle passage. The tapered portion is located on an upstream side of the minimum sectional area portion in a refrigerant flow direction. The tapered portion has a passage sectional area decreasing toward the minimum sectional area portion gradually. The expansion portion is located on a downstream side of the minimum sectional area portion in the refrigerant flow direction. The expansion portion has a passage sectional area increasing gradually.

The passage defining member has a groove that is recessed to increase the passage sectional area of the nozzle passage.

According to the first aspect, the passage sectional area of the nozzle passage can be increased drastically by the groove. The groove serves as a edge that causes a separation vortex in the refrigerant. As a result, the refrigerant is decompression-boiled inside the groove, and thereby bubbles (i.e., cavities) can be generated.

The cavities are supplied to the refrigerant flowing in the nozzle passage and serve as boiling cores. The cavities promote the boiling of the refrigerant in the nozzle passage thereby a flow speed of the refrigerant can be increased in the pressure increasing portion effectively. As a result, the ejector can secure the great energy conversion efficiency even in an operation state in which the energy conversion efficiency deteriorates easily in the nozzle passage.

Thus, according to the present disclosure, the ejector that can secure great energy conversion efficiency regardless of a load change occurring in the refrigeration cycle device can be provided.

A manufacturing method for the above-described ejector has forming the groove by pushing the passage defining member against the nozzle. According to the present disclosure, the manufacturing method for the ejector that can secure great energy conversion efficiency regardless of a load change occurring in the refrigeration cycle device can be provided.

According to a second aspect of the present disclosure, the nozzle passage of the ejector may have an annular shape in a cross section perpendicular to an axial direction of the nozzle.

The nozzle passage has a minimum sectional area portion, a tapered portion, and an expansion portion. The minimum sectional area portion has a smallest passage sectional area in the nozzle passage. The tapered portion is located on an upstream side of the minimum sectional area portion in a refrigerant flow direction. The tapered portion has a passage sectional area decreasing toward the minimum sectional area portion gradually. The expansion portion is located on a downstream side of the minimum sectional area portion in the refrigerant flow direction. The expansion portion has a passage sectional area increasing gradually.

The nozzle has a portion that defines the expansion portion. An expansion degree of the portion of the nozzle changes toward the downstream side in the refrigerant flow direction in a cross section including an axis of the nozzle. The expansion degree is a greatest at a position immediately downstream of a throat portion. The throat portion defines the minimum sectional area portion.

According to the second aspect of the present disclosure, the expansion degree is the greatest at the position immediately downstream of the throat portion. As a result, the passage sectional area of the refrigerant passage, through which the refrigerant flows after a flow speed of the refrigerant is increased in the minimum sectional portion, can be increased drastically at immediately downstream of the throat portion. Therefore, the refrigerant is decompression-boiled at immediately downstream thereby the cavities can be occurred.

The cavities are supplied to the refrigerant flowing in the nozzle passage and serves as the boiling core. Accordingly, the cavities promote the boiling of the refrigerant in the nozzle passage and thereby the flow speed of the refrigerant can be increased in the expansion portion effectively.

Thus, according to the second aspect of the present disclosure, the ejector that can secure great energy conversion efficiency regardless of a load change occurring in the refrigeration cycle device can be provided.

The ejector of the present disclosure may have a swirl flow generator that causes the refrigerant flowing into the nozzle to swirl around an axis of the nozzle.

Accordingly, the refrigerant around a swirl center is decompression-boiled in the high load operation in which the volume of the refrigerant circulating in the refrigeration cycle increases, thereby a gas-liquid two phase refrigerant in which a gas-phase refrigerant is concentrated around the swirl center, can flow into the nozzle passage. As a result, the energy conversion efficiency in the nozzle passage can be improved.

An ejector-type refrigeration cycle of the present disclosure has the above-described ejector having the swirl flow generator, a compressor, and a radiator. The compressor compresses a refrigerant to be a high-pressure refrigerant and discharges the high-pressure refrigerant. The radiator cools the high-pressure refrigerant from the compressor to be a subcooled liquid-phase refrigerant. The subcooled liquid-phase refrigerant flows into the swirl flow generator.

Accordingly, the ejector-type refrigeration cycle having the ejector that can secure great energy conversion efficiency regardless of a load change occurring in the refrigeration cycle device can be provided.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Figure 1:
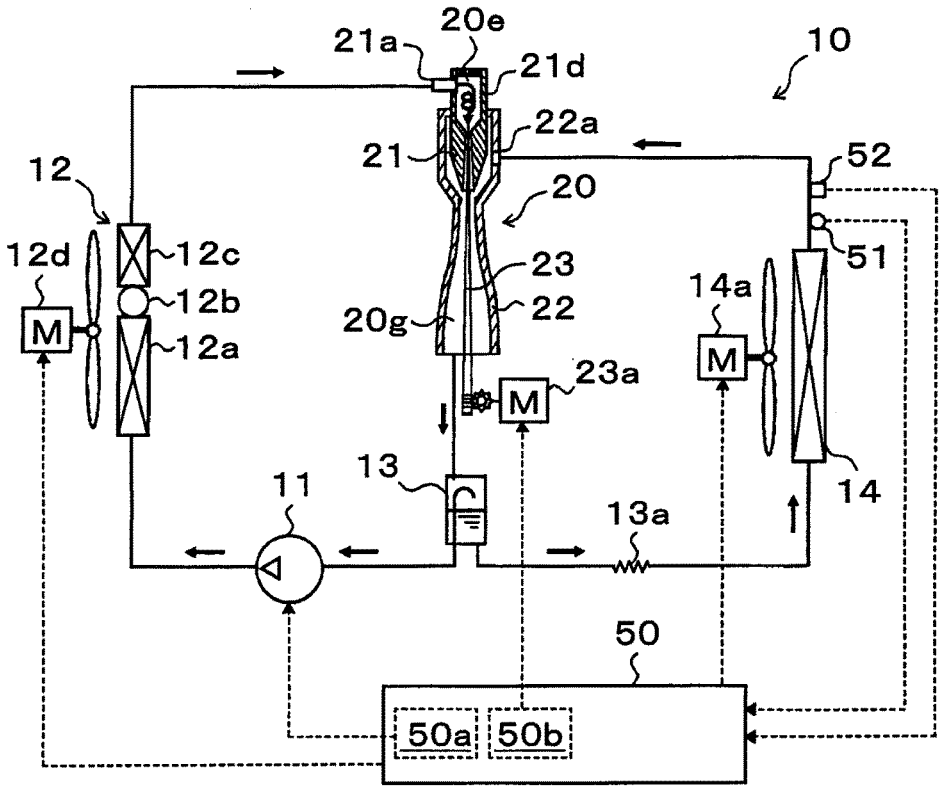
FIG. 1 is a diagram illustrating a whole configuration of an ejector-type refrigeration cycle according to a first embodiment.

Embodiments of the present disclosure will be described hereinafter referring to drawings. In the embodiments, a part that corresponds to or equivalents to a part described in a preceding embodiment may be assigned with the same reference number, and a redundant description of the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment will be described with reference to FIG. 1 to FIG. 7. An ejector 20 of the present embodiment is disposed in a vapor compression refrigeration cycle device including the ejector, i.e., an ejector-type refrigeration cycle 10 as shown in an overall configuration diagram in FIG. 1. The ejector-type refrigeration cycle 10 is disposed in a vehicle air conditioner and cools air blown into a vehicle compartment which is a space to be air conditioned. Therefore, fluid to be cooled by the ejector-type refrigeration cycle 10 of the present embodiment is the air to be blown into the vehicle compartment.

An HFC refrigerant (specifically, R134a) is employed as refrigerant in the ejector-type refrigeration cycle 10 of the present embodiment and the ejector-type refrigeration cycle 10 forms a subcritical refrigeration cycle in which a high-pressure side refrigerant pressure does not exceed a critical pressure of the refrigerant. Of course, an HFO refrigerant (specifically, R1234yf) or the like may be employed as the refrigerant. Moreover, refrigerant oil for lubricating a compressor 11 is mixed into the refrigerant and a part of the refrigerant oil circulates through the cycle together with the refrigerant.

In the ejector-type refrigeration cycle 10, the compressor 11 draws the refrigerant, increases a pressure of the refrigerant until the refrigerant becomes high-pressure refrigerant, and discharges the high-pressure refrigerant. Specifically, the compressor 11 of the present embodiment has a housing that houses a compression mechanism and an electric motor. The compression mechanism is a fixed capacity type compression mechanism and driven by the electric motor.

Various compression mechanisms such as a scroll compression mechanism and a vane compression mechanism can be employed as the compression mechanism. Operation (e.g., a rotation speed) of the electric motor is controlled by control signals output from an air conditioning controller 50 described later. The electric motor may employ any of an AC motor and a DC motor.

A refrigerant inlet of a condensing portion 12*a* of a radiator 12 is connected to a discharge port of the compressor 11. The radiator 12 is a heat dissipating heat exchanger that performs a heat exchange between high-pressure refrigerant discharged from the compressor 11 and air (i.e., outside air), thereby causing the high-pressure refrigerant to dissipate heat to cool the refrigerant. The outside air is air outside the vehicle compartment and blown by a cooling fan 12*d*.

Specifically, the radiator 12 exchanges heat between the high-pressure gas-phase refrigerant discharged from the compressor 11 and the outside air blown by the cooling fan 12*d*. The radiator 12 includes the condensing portion 12*a*, a receiver portion 12*b*, and a subcooling portion 12*c*. The condensing portion 12*a* causes the high-pressure gas-phase refrigerant to radiate heat to condense the refrigerant. The receiver portion 12*b* separates the refrigerant flowing out of the condensing portion 12*a* into a gas-phase refrigerant and a liquid-phase refrigerant and stores an excess liquid-phase refrigerant. The subcooling portion 12*c* performs a heat exchange between the liquid-phase refrigerant flowing out of the receiver portion 12*b* and the outside air blown from the cooling fan 12*d*, thereby subcooling the liquid-phase refrigerant. The radiator 12 is what is called a subcool condenser.

The cooling fan 12*d* is an electric blower. A rotation speed of the cooling fan 12*d*, i.e., a volume of air blown by the cooling fan 12*d*, is controlled based on a control voltage output from the air conditioning controller 50.

A refrigerant inlet 21*a* of the ejector 20 is connected to a refrigerant outlet of the subcooling portion 12*c* of the radiator 12. The ejector 20 functions as a refrigerant pressure reducer that reduces a pressure of the subcooled high-pressure liquid-phase refrigerant flowing out of the radiator 12 and that causes the refrigerant to flow out to a downstream side. The ejector 20 also functions as a refrigerant circulating portion (i.e., a refrigerant transfer portion) that draws (i.e., transfers) the refrigerant flowing out of an evaporator 14 (described later) using a suction force of the injection refrigerant jetted at high speed.

Figure 2:
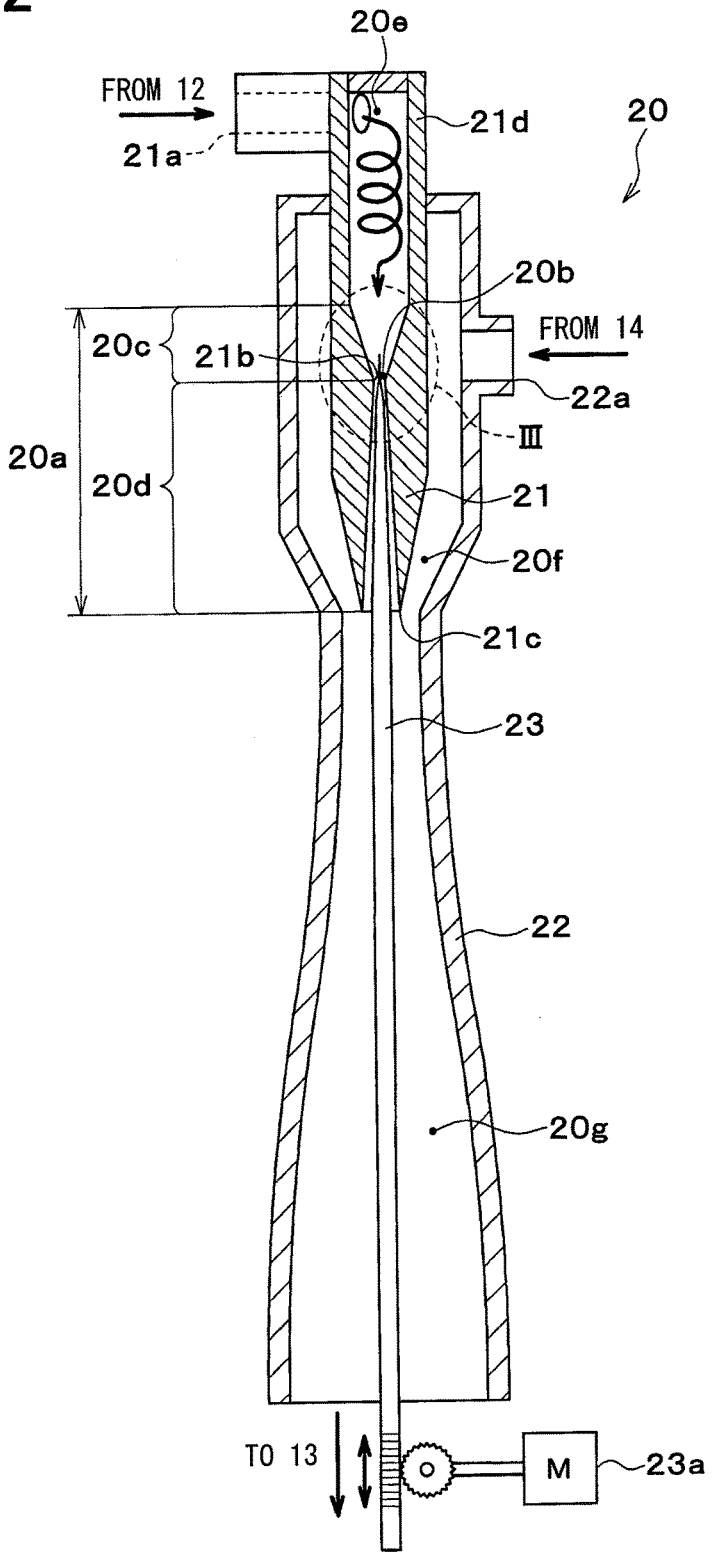
FIG. 2 is a cross-sectional view illustrating an ejector and taken along an axial direction of the ejector, according to the first embodiment.

A specific configuration of the ejector 20 will be described with reference to FIG. 2 to FIG. 4. The ejector 20 has a nozzle 21, a body 22, and a needle valve 23. The nozzle 21 is made of metal (e.g., a stainless alloy) and has a substantially cylindrical shape that is gradually tapered in a refrigerant flow direction. The nozzle 21 isentropically reduces the pressure of the refrigerant by use of a nozzle passage 20*a* defined in the nozzle 21 and jets the refrigerant.

The needle valve 23 having a needle-shape is disposed as a passage defining member in the nozzle 21. A refrigerant passage formed between an inner surface of the nozzle 21 and an outer surface of the needle valve 23 has at least a part of the nozzle passage 20*a* that reduces the pressure of the refrigerant. In other words, at least a part of the nozzle passage 20*a* that reduces the pressure of the refrigerant is formed between the inner surface of the nozzle 21 and the outer surface of the needle valve 23. Therefore, the nozzle passage 20*a* has an annular shape in a cross section perpendicular to the axial direction in an area in which the nozzle 21 and the needle valve 23 are overlapped when viewed in a direction perpendicular to an axial direction of the nozzle 21.

The nozzle 21 has a throat portion 21*b* forming a minimum sectional area portion 20*b* (i.e., a smallest passage sectional area portion) with a smallest sectional area of the refrigerant passage, on an inner wall surface of the nozzle 21. The nozzle passage 20*a* is provided with the minimum sectional area portion 20*b*, a tapered portion 20*c*, and an expansion portion 20*d*. The minimum sectional area portion 20*b* has the smallest sectional area in the nozzle passage 20*a*. The tapered portion 20*c* is located on an upstream side of the minimum sectional area portion 20*b* in the refrigerant flow direction and has a passage sectional area decreasing toward the minimum sectional area portion 20*b* gradually. The expansion portion 20*d* is located on a downstream side of the minimum sectional area portion 20*b* in the refrigerant flow direction and has a passage sectional area gradually increasing as the expansion portion 20*d* extends away from the minimum sectional area portion 20*b*.

Therefore, in the nozzle passage 20*a* of the present embodiment, the sectional area of the refrigerant passage changes similarly to a Laval nozzle. Moreover, according to the present embodiment, the sectional area of the refrigerant passage, which is defined in the nozzle passage 20*a*, is changed such that a flow speed of the injection refrigerant injected from a refrigerant injection port 21*c* becomes a sound speed or higher in a normal operation of the ejector-type refrigeration cycle.

A cylindrical portion 21*d* extending coaxially with the axial direction of the nozzle 21 is provided on an upstream side of a portion of the nozzle 21 forming the nozzle passage 20*a* in the refrigerant flow direction. The cylindrical portion 21*d* has a swirl space 20*e* in which the refrigerant flowing into the nozzle 21 swirled. The swirl space 20*e* has a substantially columnar shape and extends coaxially with the axial direction of the nozzle 21.

Furthermore, a refrigerant inflow passage, which guides the refrigerant to flow into the swirl space 20*e* from an outside of the ejector 20, extends in a tangential direction of an inner wall surface of the swirl space 20*e* when viewed in an axial direction of the swirl space 20*e*. In this way, the subcooled liquid-phase refrigerant flowing out of the radiator 12 and flowing into the swirl space 20*e* flows along the inner wall surface of the swirl space 20*e* and swirls about the central axis of the swirl space 20*e*.

A centrifugal force acts on the refrigerant swirling in the swirl space 20*e*, and thus the refrigerant pressure is lower near the central axis than on an outer peripheral side in the swirl space 20*e*. Therefore, according to the present embodiment, dimensions of the swirl space 20*e* etc. are set, such that a refrigerant pressure near the central axis of the swirl space 20*e* is reduced to a pressure at which the refrigerant becomes a saturated liquid-phase refrigerant in an intermediate load operation and in a high load operation. Alternatively, the dimensions of the swirl space 20*e* etc. are set, such that the refrigerant pressure near the central axis of the swirl space 20*e* is reduced to a pressure at which the refrigerant is decompression-boiled in the intermediate load operation and in the high load operation. In the intermediate load operation, a thermal load in the ejector-type refrigeration cycle 10 is an intermediate value. In the high load operation, the thermal load is a relatively high load. The pressure at which the refrigerant is decompression-boiled is, in other words, a pressure at which the cavitation occurs.

Adjustment of the refrigerant pressure near the central axis in the swirl space 20*e* can be achieved by adjusting a swirl speed of the refrigerant swirling in the swirl space 20*e*. The swirl speed can be adjusted by adjusting dimensions such as a ratio between a passage sectional area of the refrigerant inflow passage and a sectional area of a cross section of the swirl space 20*e* perpendicular to an axial direction, for example. The swirl speed in the present embodiment refers to a speed in a swirling direction of the refrigerant near an outermost peripheral portion in the swirl space 20*e*.

Therefore, according to the present embodiment, the cylindrical portion 21*d* and the swirl space 20*e* configure a swirl flow generator that causes the subcooled liquid-phase refrigerant flowing into the nozzle 21 to swirl around the axis of the nozzle 21. In other words, in the present embodiment, the ejector 20 (specifically, the nozzle 21) and the swirl flow generator are configured integrally.

The body 22 is made of metal (e.g., aluminum) or a resin and has a substantially cylindrical shape. The body 22 functions as a fixing member which supports and fixes the nozzle 21 to an inside of the body and forms an outer shell of the ejector 20. Specifically, the nozzle 21 is fixed by press-fitting so as to be housed into one end side of the body 22 in a longitudinal direction. Therefore, the refrigerant does not leak from a fixed portion (press-fitted portion) between the nozzle 21 and the body 22.

The body 22 is provided with a refrigerant suction port 22*a* that is provided at the outer surface, which corresponds to the outer surface of the nozzle 21, of the body 22. The refrigerant suction port 22*a* penetrates the body 22 to communicate with the refrigerant injection port 21*c* of the nozzle 21. The refrigerant suction port 22*a* is a through hole that draws the refrigerant, flowing out of the evaporator 14, from the outside to the inside of the ejector 20 by using a suction force of the injection refrigerant jetting out of the nozzle 21.

Moreover, the body 22 has therein a suction passage 20*f* and a diffuser portion 20*g*. The suction passage 20*f* guides the suction refrigerant drawn from the refrigerant suction port 22*a* toward the refrigerant injection port of the nozzle 21. The diffuser portion 20*g* is a pressure increasing portion that mixes the suction refrigerant flowing into the ejector 20 from the refrigerant suction port 22*a* and the injection refrigerant and increases the pressure of the refrigerant.

The diffuser portion 20*g* is formed by a space which is provided to be continuous from an outlet of the suction passage 20*f* and in which the sectional area of the refrigerant passage increases gradually. In this way, the diffuser portion 20*g* reduces flow velocities of the injection refrigerant and the suction refrigerant while mixing the injection refrigerant and the suction refrigerant to thereby increase a pressure of the mixed refrigerant. In other words, the diffuser portion 20*g* converts velocity energy of the mixed refrigerant into pressure energy.

The needle valve 23 functions as the passage defining member and changes the passage sectional area of the nozzle passage 20*a*. Specifically, the needle valve 23 is made of a thermoplastic resin (e.g., PPS: polyphenylene sulfide). The needle valve 23 has a needle shape tapered from a side adjacent to the diffuser portion 20*g* toward the upstream side in the refrigerant flow direction (i.e., toward the nozzle passage 20*a*).

Furthermore, the needle valve 23 is disposed coaxially with the nozzle 21. A stepping motor 23*a* as a drive portion for displacing the needle valve 23 in the axial direction of the nozzle 21 is connected to an end portion of the needle valve 23 on the diffuser portion 20*g* side. Operation of the stepping motor 23*a* is controlled by use of control pulses output from the air conditioning controller 50.

Figure 3:
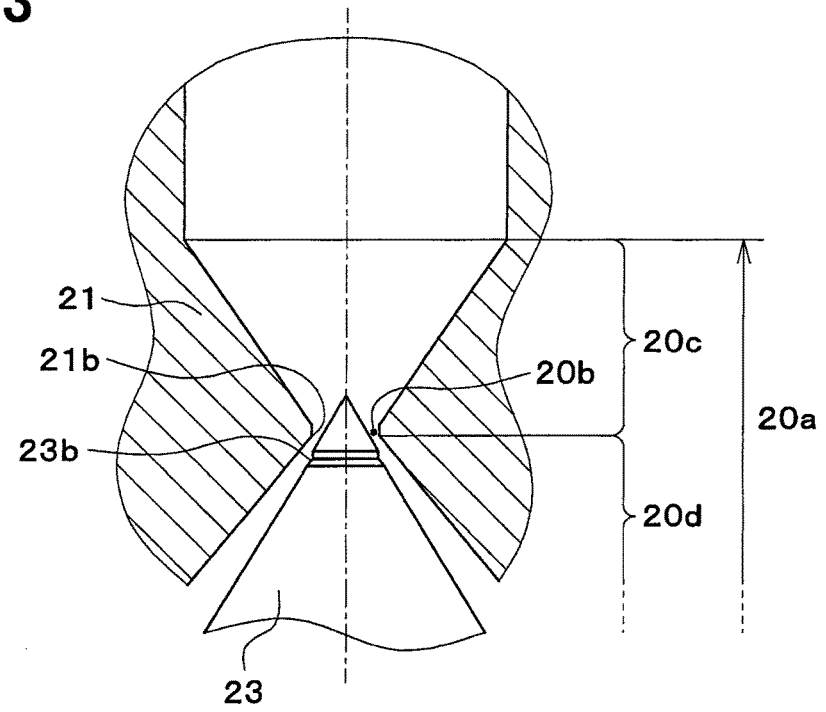
FIG. 3 is an enlarged cross-sectional view illustrating a portion III shown in FIG. 2.
Figure 4:
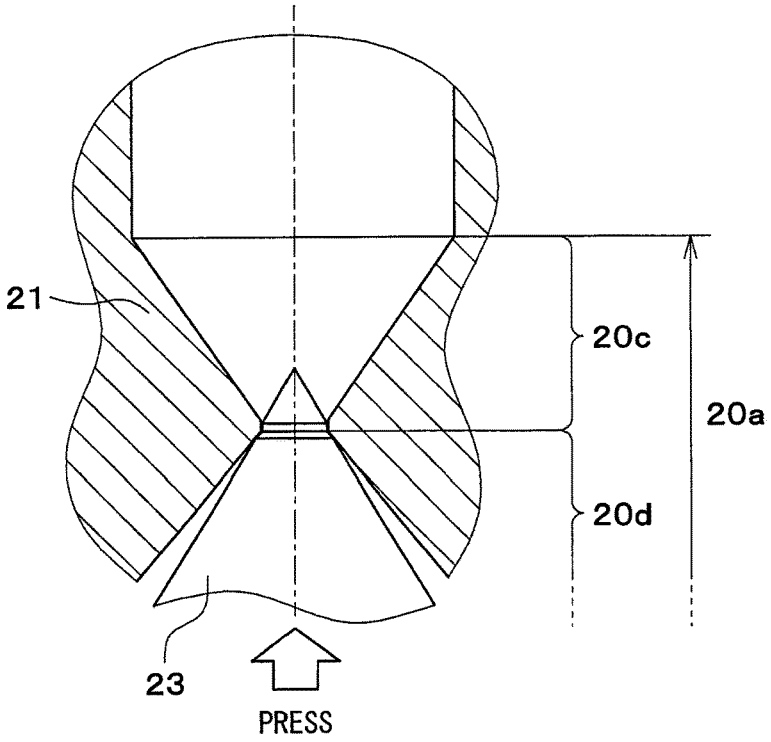
FIG. 4 is an enlarged cross-sectional view corresponding to FIG. 3 and illustrating forming a groove according to the first embodiment.

On the other hand, the needle valve 23 has an end portion on a side adjacent to the nozzle passage 20*a*, and the end portion is provided with a groove 23*b* as shown in FIG. 3. The groove 23*b* extends over an entire circumference of the end portion in a circumferential direction centering the axis of the nozzle 21. The groove 23*b* is recessed in such a direction as to increase the passage sectional area of the nozzle passage 20*a*. FIG. 3 and FIG. 4 are schematic partial sectional views in which dimensions in a direction perpendicular to the axis of the nozzle 21 are enlarged as compared with dimensions in a direction of the axis of the nozzle 21 for clear explanation.

Here, a method of forming the groove 23*b* will be described. The groove 23*b* is formed while the ejector 20 is manufactured. In other words, forming the groove 23*b* (i.e., a process of forming the groove) is a part of a process flow included in a manufacturing method of the ejector 20 of the present embodiment.

Specifically, when forming the groove 23*b*, the needle valve 23 made of the thermoplastic resin is heated. The needle valve 23, being softened by being heated, is pushed against the nozzle 21 so as to close the throat portion 21*b* of the nozzle 21. At this time, the needle valve 23 is pushed against the nozzle 21 on a condition that a central axis of the needle valve 23 is positioned coaxially with the axis of the nozzle 21 (see FIG. 4).

Then, when the needle valve 23 is moved away from the nozzle 21, a shape of the throat portion 21*b* is transferred to a tip end portion of the needle valve 23, which is a tip of the needle valve 23 on a side adjacent to the nozzle passage 20*a*, in a manner that the throat portion 21*b* of the nozzle 21 functions as a male die (see FIG. 3). As a result, the tip end portion of the needle valve 23 adjacent to the nozzle passage 20*a* has the groove 23*b*.

Therefore, when the stepping motor 23*a* moves the needle valve 23 and the needle valve 23 is in contact with the nozzle 21, the inner surface of the nozzle 21 and the outer surface of the needle valve 23 are in surface contact with each other. When the stepping motor 23*a* moves the needle valve 23 and the needle valve 23 is separated from the nozzle 21, the groove 23*b* is positioned immediately downstream of the minimum sectional area portion 20*b* in the refrigerant flow direction as shown in FIG. 3 when viewed in the direction perpendicular to the axis of the nozzle 21.

As shown in FIG. 1, an inlet side of a gas-liquid separator 13 is connected to a refrigerant outlet of the diffuser portion 20*g* of the ejector 20. The gas-liquid separator 13 is a gas-liquid separating portion that separates the refrigerant, flowing out of the diffuser portion 20*g* of the ejector 20, into a gas phase refrigerant and a liquid phase refrigerant. In the present embodiment, the gas-liquid separator 13 has a relatively small inner capacity and causes most of the separated liquid-phase refrigerant to flow out of a liquid-phase refrigerant outlet while storing little amount of the liquid-phase refrigerant. However, the gas-liquid separator 13 may have a function as a reservoir portion that stores an excess liquid-phase refrigerant in the cycle.

A suction port of the compressor 11 is connected to a gas-phase refrigerant outlet of the gas-liquid separator 13. On the other hand, a refrigerant inlet of the evaporator 14 is connected to a liquid-phase refrigerant outlet of the gas-liquid separator 13. A fixed throttle 13*a* as a pressure reducer is located between the refrigerant inlet of the evaporator 14 and the liquid-phase refrigerant outlet of the gas-liquid separator 13. The fixed throttle 13*a* may be an orifice, a capillary tube, or the like.

The evaporator 14 is a heat absorbing heat exchanger that performs a heat exchange between the low-pressure refrigerant, flowing into the evaporator 14, and the air, blown by a blower fan 14*a* and flowing toward the vehicle compartment. Accordingly, the low-pressure refrigerant evaporates and thereby exerts a heat absorbing effect in the evaporator 14. The blower fan 14*a* is an electric blower. A rotation speed of the blower fan 14*a* is controlled by a control voltage output from the air conditioning controller 50. In other words, a volume of air blown by the blower fan 14*a* is controlled by the control voltage output from the air conditioning controller 50. A refrigerant outlet of the evaporator 14 is connected to the refrigerant suction port 22*a* of the ejector 20.

Next, a general outline of an electric control section of the present embodiment will be described. The air conditioning controller 50 has a well-known microcomputer including CPU, ROM, and RAM and a peripheral circuit of the microcomputer. The air conditioning controller 50 performs various computations and processing based on control programs stored in the ROM and controls operations of various electric actuators (e.g., the motor) for the compressor 11, the cooling fan 12*d*, the blower fan 14*a*, the needle valve 23, and the like.

Various sensors for air conditioning control such as an inside air temperature sensor, an outside air temperature sensor, a insolation sensor, an evaporator outlet-side temperature sensor (i.e., an evaporator outlet-side temperature detecting portion) 51, an evaporator outlet-side pressure sensor (i.e., an evaporator outlet-side pressure detecting portion) 52, a radiator outlet-side temperature sensor, and a radiator outlet-side pressure sensor are connected to the air conditioning controller 50. Detection values of the various sensors are input to the air conditioning controller 50. The inside air temperature sensor detects a temperature (i.e., an inside air temperature) Tr in the vehicle compartment. The outside air temperature sensor detects an outside air temperature Tam. The insolation sensor detects an insolation amount As in the vehicle compartment. The evaporator outlet-side temperature sensor 51 detects a refrigerant temperature (i.e., an evaporator outlet-side temperature) Te on an outlet side of the evaporator 14. The evaporator outlet-side pressure sensor 52 detects a refrigerant pressure (i.e., an evaporator outlet-side pressure) Pe on the outlet side of the evaporator 14. The radiator outlet-side temperature sensor detects a refrigerant temperature Td on an outlet side of the radiator 12. The radiator outlet-side pressure sensor detects a refrigerant pressure Pd on the outlet side of the radiator 12.

Furthermore, an operation panel (not shown) disposed near an instrument panel at a front portion in the vehicle compartment is connected to an input side of the air conditioning controller 50 and operation signals from various operation switches provided to the operation panel are input to the air conditioning controller 50. As the various operation switches provided to the operation panel, an air conditioning actuation switch for requesting the air conditioning in the vehicle compartment, a vehicle compartment temperature setting switch for setting a vehicle compartment temperature Tset, and the like are provided.

The air conditioning controller 50 of the present embodiment is integrally formed with control sections that control operation of various devices which are connected to an output side of the air conditioning controller 50 and which are to be controlled. In the air conditioning controller 50, configurations (i.e., hardware and software) for controlling operation of the respective devices to be controlled form the control sections for the respective devices to be controlled.

For example, in the present embodiment, the configuration for controlling operation of the compressor 11 forms a discharge capacity control section 50*a*. The configuration for controlling the operation of the stepping motor 23*a* forms a valve control section 50*b*. The discharge capacity control section 50*a* and the valve control section 50*b* may be formed by controllers separate from the air conditioning controller 50.

Next, operation of the present embodiment with the above configuration will be described. In the air conditioner for the vehicle of the present embodiment, the air conditioning controller 50 executes the air conditioning control program stored in advance when the air conditioning actuation switch of the operation panel is thrown (turned on).

In the air conditioning control program, the air conditioning controller 50 reads detection signals from the above-described sensors for the air conditioning control and the operation signals from the operation panel. The air conditioning controller calculates a target blowing temperature TAO, which is a target temperature of the air to be blown into the vehicle compartment, based on the detection signals and operation signals.

The target blowing temperature TAO is calculated using the following mathematical expression F1.

$$TAO = Kset \times Tset - Kr \times Tr - Kam \times Tam - Ks \times As + C \quad \text{(F1)}$$

Tset is the vehicle compartment temperature set by the temperature setting switch. Tr is the inside air temperature detected by the inside air temperature sensor. Tam is the outside air temperature detected by the outside air temperature sensor. As is the insolation amount detected by the insolation sensor. Kset, Kr, Kam, and Ks are control gains and C is a constant for correction.

Furthermore, in the air conditioning control program, the air conditioning controller 50 detects operation states of the various devices, which are connected to the output side of the air conditioning controller 50, are determined based on the calculated target blowing temperature TAO and the detection signals from the sensors.

For example, a refrigerant discharge capacity of the compressor 11, i.e., the control signal output to the electric motor of the compressor 11 is determined as follows. The air conditioning controller 50 determines a target evaporator blowing temperature TEO, which is a temperature of the air flowing out of the evaporator 14, using the target blowing temperature TAO and a control map. The control map is stored in a memory circuit in advance.

Based on a deviation (TEO-Te) of the evaporator outlet-side temperature Te detected by the evaporator outlet-side temperature sensor 51 from the target evaporator blowing temperature TEO, the control signal to be output to the electric motor of the compressor 11 is determined so that the evaporator outlet-side temperature Te approaches the target evaporator blowing temperature TEO by use of a feedback control method.

Specifically, the discharge capacity control section 50*a* of the present embodiment controls the refrigerant discharge capacity of the compressor 11 such that a volume of the refrigerant circulating in the cycle increases as the deviation (TEO-Te) increases, i.e., the heat load on the ejector-type refrigeration cycle 10 increases.

The control pulse to be output to the stepping motor 23*a*, which moves the needle valve 23, is determined such that a superheat degree SH of the refrigerant on the outlet side of the evaporator 14 approaches a reference superheat degree KSH that is determined in advance. The superheat degree SH is calculated using the evaporator outlet-side temperature Te and the evaporator outlet-side pressure Pe detected by the evaporator outlet-side pressure sensor 52.

Specifically, the valve control section 50*b* of the present embodiment controls the operation of the stepping motor 23*a* so that the passage sectional area of the minimum sectional area portion 20*b* increases as the superheat degree SH of the refrigerant on the outlet side of the evaporator 14 increases.

The air conditioning controller 50 outputs the determined control signals etc. to the various devices. Subsequently, the air conditioning controller 50 performs a control routine repeatedly at specified intervals until a stop request, which is a request to stop an operation of the air conditioning controller 50, is made. The control routine includes reading the detection signals and the operation signals, calculating the target blowing temperature TAO, determining the operation states of the various devices, and outputting the controls signals.

As a result, the refrigerant circulates in the ejector-type refrigeration cycle 10 as shown by thick solid arrows in FIG. 1. Then, a state of the refrigerant changes as shown in a Mollier diagram in FIG. 5.

More specifically, the high-temperature and high-pressure refrigerant discharged from the compressor 11 (point a in FIG. 5) flows into the condensing portion 12*a* of the radiator 12, exchanges heat with the outside air blown from the cooling fan 12*d*, and dissipates heat thereby being condensed. The refrigerant condensed in the condensing portion 12*a* is separated into gas-phase refrigerant and liquid-phase refrigerant in the receiver portion 12*b*. The liquid-phase refrigerant separated in the receiver portion 12*b* exchanges heat with the outside air blown from the cooling fan 12*d* in the subcooling portion 12*c* and further dissipates heat to become the subcooled liquid-phase refrigerant (from point a to point b in FIG. 5).

Figure 5:
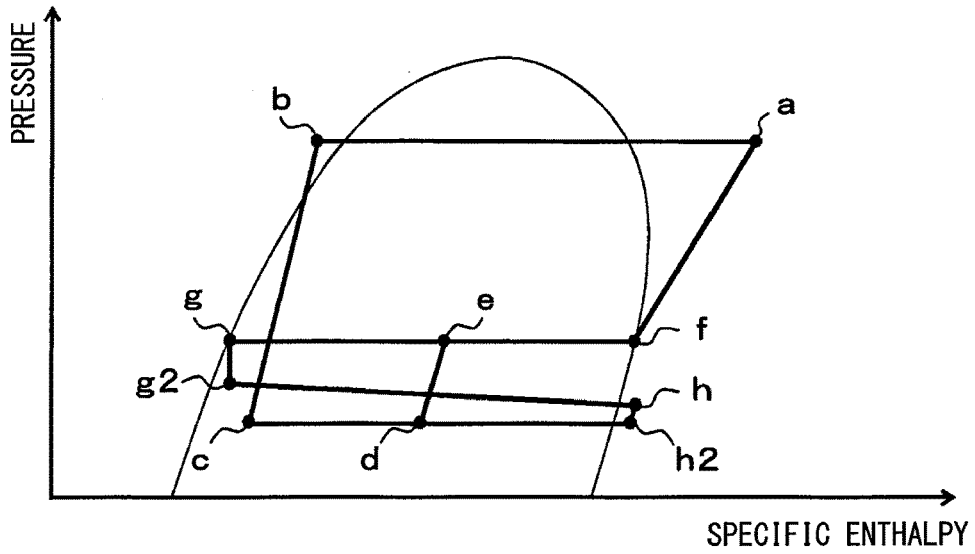
FIG. 5 is a Mollier diagram showing a variation of refrigerant states in the ejector-type refrigeration cycle according to the first embodiment.

The nozzle passage 20*a* of the ejector 20 reduces a pressure of the subcooled liquid-phase refrigerant, flowing out of the subcooling portion 12*c* of the radiator 12, isentropically and injects the subcooled liquid-phase refrigerant (from point b to point c in FIG. 5). At this time, the valve control section 50*b* controls the stepping motor 23*a* so that the superheat degree SH of the refrigerant (point h in FIG. 5) on the outlet side of the evaporator 14 approaches the reference superheat degree KSH determined in advance.

The refrigerant (point h in FIG. 5) flowing out of the evaporator 14 is drawn into the refrigerant suction port 22*a* using a suction force of the injection refrigerant jetting out of the nozzle passage 20*a*. The injection refrigerant jetting out of the nozzle passage 20*a* and the suction refrigerant drawn into the refrigerant suction port 22*a* flow into the diffuser portion 20*g* and join each other (from point c to point d, from point h2 to point d in FIG. 5).

Here, the suction passage 20*f* of the present embodiment has the shape that decreases the passage sectional area gradually in the refrigerant flow direction. Therefore, the flow speed of the suction refrigerant passing through the suction passage 20*f* increases while a pressure of the suction refrigerant decreases (from point h to point h2 in FIG. 5). In this way, a difference between the flow speed of the suction refrigerant and a flow speed of the injection refrigerant is reduced and an energy loss (mixing loss) caused when mixing of the suction refrigerant and the injection refrigerant in the diffuser portion 20*g* is reduced.

In the diffuser portion 20*g*, due to the increase in the sectional area of the refrigerant passage, kinetic energy of the refrigerant is converted into pressure energy. In this way, while the injection refrigerant and the suction refrigerant are mixed, the pressure of the mixed refrigerant increases (from point d to point e in FIG. 5). The refrigerant flowing out of the diffuser portion 20*g* is separated into the gas and the liquid in the gas-liquid separator 13 (from point e to f, from point e to g in FIG. 5).

The liquid-phase refrigerant separated in the gas-liquid separator 13 is reduced in pressure in the fixed throttle 13*a* (from point g to point g2 in FIG. 5) and flows into the evaporator 14. The refrigerant flowing into the evaporator 14 absorbs heat from the air blown by the blower fan 14*a* and evaporates in the evaporator 14 (from point g2 to point h in FIG. 5) thereby cooling the air. On the other hand, the gas-phase refrigerant separated in the gas-liquid separator 13 is drawn into the compressor 11 and compressed again (from point f to point a in FIG. 5).

The ejector-type refrigeration cycle 10 of the present embodiment operates as described above and can cool the air blown into the vehicle compartment.

At this time, according to the ejector-type refrigeration cycle 10 of the present embodiment, the refrigerant is drawn into the compressor 11 after the diffuser portion 20*g* of the ejector 20 increases the pressure of the refrigerant.

Therefore, consumption power used by the compressor 11 can be reduced and thereby a coefficient of performance (COP) can be improved according to the ejector-type refrigeration cycle 10 as compared to a normal refrigeration cycle device in which a refrigerant evaporation pressure in an evaporator and a pressure of refrigerant drawn into a compressor are substantially equal to each other.

Since the ejector 20 of the present embodiment has the needle valve 23 as the passage defining member and the stepping motor 23*a* as the drive portion, it is possible to adjust the passage sectional area of the minimum sectional area portion 20*b* depending on load variation in the ejector-type refrigeration cycle 10. Therefore, it is possible to cause the ejector 20 to operate suitably depending on the load variation in the ejector-type refrigeration cycle 10.

Furthermore, according to the ejector 20 of the present embodiment, it is possible to reduce the refrigerant pressure near the swirling center in the swirl space 20*e* to the pressure at which the refrigerant becomes the saturated liquid-phase refrigerant or the pressure at which the refrigerant boils under reduced pressure in a manner that the refrigerant is caused to swirl in the swirl space 20*e* during the intermediate load operation and high load operation of the ejector-type refrigeration cycle 10. The pressure at which the refrigerant boils under reduced pressure is the pressure at which the cavitation occurs.

Figure 6:
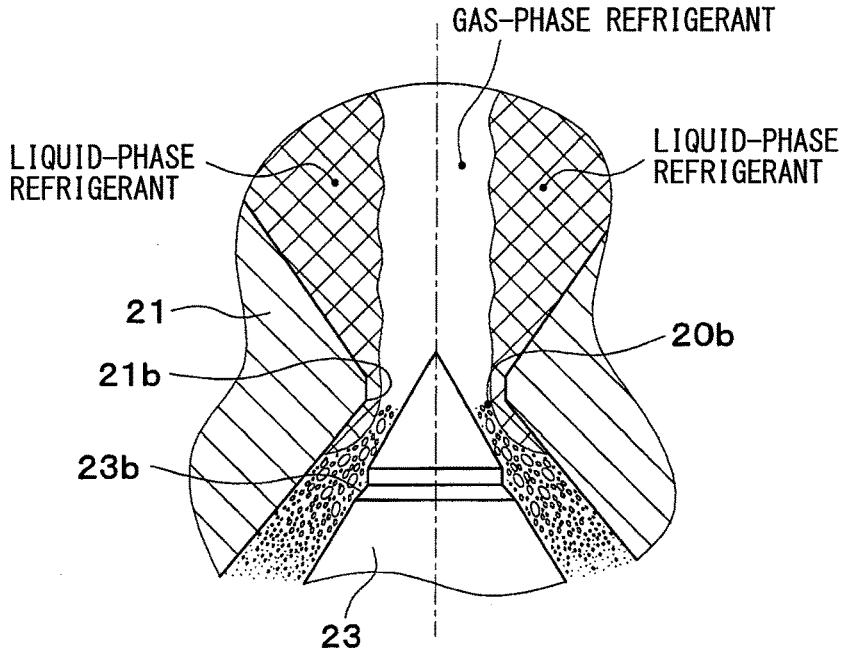
FIG. 6 is an explanatory diagram illustrating how the refrigerant boils when the ejector is operated in a range from an intermediate load operation to a high load operation according to the first embodiment.
Figure 7:
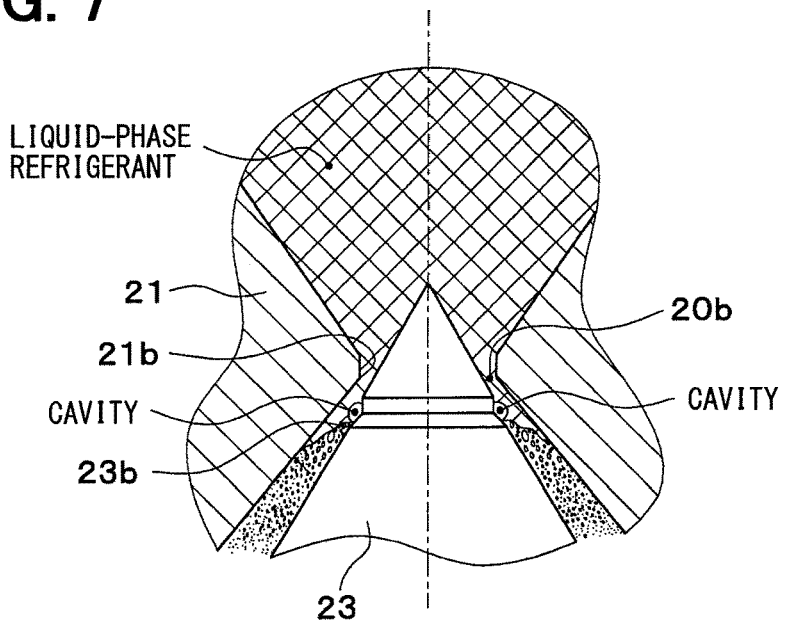
FIG. 7 is an explanatory diagram illustrating how the refrigerant boils when the ejector is operated in a low load operation according to the first embodiment.

Accordingly, as shown in FIG. 6, the gas-phase refrigerant is concentrated around a swirl center and swirls in a columnar shape around the swirl center. In other words, a gas column is caused centering the swirl center. As a result, the refrigerant swirls in the swirl space 20*e* in a two-phase separated state in which the gas-phase refrigerant is concentrated around the swirl center and the liquid-phase refrigerant is concentrated outside the gas-phase refrigerant. FIG. 6 and FIG. 7 show the same section as FIG. 3 in further enlarged views and are explanatory views schematically showing a state of boiling of the refrigerant. In FIG. 6 and FIG. 7, the liquid-phase refrigerant is hatched for clear explanation.

According to the ejector 20 of the present embodiment, the refrigerant swirling around the swirl center can be decompression-boiled, and thereby the refrigerant in the two-phase separated state, in which the gas-phase refrigerant is concentrated around the swirl center, can flow into the nozzle passage 20*a* during, e.g., the high load operation in which a large volume of the refrigerant circulates in the cycle. The nozzle passage 20*a* therein has the refrigerant passage having the annular shape in cross section perpendicular to the center of the nozzle passage 20*a*. The refrigerant passage has an outer wall surface and an inner wall surface located between the swirl center and the outer wall surface. The refrigerant boils near the outer wall surface when the refrigerant separates from the outer wall surface, and the cavitation occurs in the refrigerant swirling near the inner wall surface and then causes an interfacial boiling near the inner surface using boiling cores generated by the cavitation, in a manner that the refrigerant is caused to be in the two-phase separated state in the swirl space 20*e* and flows into the nozzle passage 20*a*. The boiling near the outer wall surface and the interfacial boiling promote the boiling of the refrigerant in the nozzle passage 20*a*.

As a result, the refrigerant flowing into the minimum sectional area portion 20*b* of the nozzle passage 20*a* comes into the gas-liquid mixed state in which the gas phase and the liquid phase are mixed uniformly. Then, blockage (i.e., choking) occurs in the flow of the gas-liquid mixed refrigerant near the minimum sectional area portion 20*b*. The choking causes a flow speed of the gas-liquid mixed refrigerant to reach a sound speed. The gas-liquid mixed refrigerant having the sound speed is accelerated in the expansion portion 20*d* and injected from the expansion portion 20*d*.

As described above, the boiling of the refrigerant is promoted by both of the boiling near the outer wall surface and the interfacial boiling, and thereby the flow speed of the refrigerant in the gas-liquid mixed state can be increased to the sound speed in the intermediate load operation and the high load operation. As a result, the energy conversion efficiency in the nozzle passage 20*a* can be improved.

On the other hand, in a low load operation of the cycle, the volume of the refrigerant circulating in the cycle is reduced, and thereby the swirl speed of the refrigerant swirling in the swirl space 20*e* decreases. Therefore, it is difficult to reduce the pressure of the refrigerant near the swirling center in the swirl space 20*e* to the pressure at which the refrigerant boils under reduced pressure. As a result, in the low load operation, the boiling of the refrigerant is hardly facilitated by the interfacial boiling, and thereby the ejector 20 may not be able to exert high energy conversion efficiency.

Then, according to the present embodiment, the groove 23*b* is provided with the needle valve 23 to increase the passage sectional area of the nozzle passage 20*a* drastically. The groove 23*b* serves as an edge that generates a separation vortex in the refrigerant. Therefore, as shown in FIG. 7, the refrigerant is decompression-boiled in the groove 23*b*, and thereby bubbles (i.e., cavities) can be generated. In other words, the groove 23*b* is located at a position where the liquid-phase refrigerant flowing into the nozzle passage 20*a* starts boiling.

The cavities join the refrigerant flowing through the nozzle passage 20*a* and serve as the boiling cores, thereby the boiling of the refrigerant in the nozzle passage 20*a* is facilitated and the flow speed of the refrigerant can be increased effectively in the expansion portion 20*d*. As a result, the ejector 20 of the present embodiment can exert high energy conversion efficiency even in an operation, e.g., in the low load operation, in which the refrigerant hardly boils in the swirl space 20*e*.

That is, according to the ejector 20 of the present embodiment, it is possible to cause the ejector 20 to exert the high energy conversion efficiency regardless of the load variation in the ejector-type refrigeration cycle 10 to which the ejector 20 is disposed.

Here, when only a part of the refrigerant boils in the nozzle passage 20*a*, the needle valve 23 may be inclined. Then, according to the ejector of the present embodiment, the groove 23*b* extends over the entire circumference of the nozzle 21 in the circumferential direction centering the axis of the nozzle 21, and thereby causing the cavities over the entire circumference. Therefore, the boiling cores can be supplied uniformly to the refrigerant passing through the refrigerant passage, which is defined in the nozzle passage 20*a* and has the annular shape. In other words, the boiling cores can be supplies uniformly in the circumferential direction inside the refrigerant passage that is defined in the nozzle passage 20*a* to have the annular shape in the cross section. As a result, the needle valve 23 can be prevented from being inclined.

Moreover, according to the ejector 20 of the present embodiment, the valve control section 50*b* of the air conditioning controller 50 controls the operation of the stepping motor 23*a* such that the superheat degree SH of the refrigerant on the outlet side of the evaporator 14 approaches the reference superheat degree KSH. Therefore, the needle valve 23 moves in such a direction as to reduce the passage sectional area of the minimum sectional area portion 20*b* in the low load operation in which the volume of the refrigerant circulating in the cycle reduces.

Therefore, in the low load operation, the groove 23*b* of the needle valve 23 can be positioned immediately downstream of the minimum sectional area portion 20*b* of the nozzle passage 20*a* in the refrigerant flow direction. The groove 23*b* drastically increases the sectional area of the refrigerant passage into which the refrigerant flows after the minimum sectional area portion 20*b* increases the flow speed of the refrigerant. As a result, the cavities can be generated in the groove 23*b* more effectively.

Since the cavities are generated in the groove 23*b*, the cavities do not reduce the practical passage sectional area of the nozzle passage 20*a*. Accordingly, an increase of a pressure loss caused when the refrigerant flows through the nozzle passage 20*a* can be suppressed.

In addition, cavitation does not occur in the groove 23*b* since the liquid-phase refrigerant does not flow into the groove 23*b* as shown in FIG. 6 in the intermediate load operation and the high load operation. Therefore, in the intermediate load operation and the high load operation, an increase of a quantity of the bubbles, which join the refrigerant passing through the nozzle passage 20*a* and serves as the boiling cores in the refrigerant, can be suppressed, and thereby an increase of the pressure loss caused when the refrigerant flows in the nozzle passage 20*a* can be suppressed.

Furthermore, according to the ejector 20 of the present embodiment, the inner surface of the nozzle 21 and the outer surface of the needle valve 23 are in surface contact with each other when the stepping motor 23 moves the needle valve 23 to be in contact with the nozzle 21. As a result, reliability of a sealing between the needle valve 23 and the nozzle passage 20*a* can be improved, and the passage sectional area of the minimum sectional area portion 20*b* can be adjusted accurately.

Second Embodiment

Figure 8:
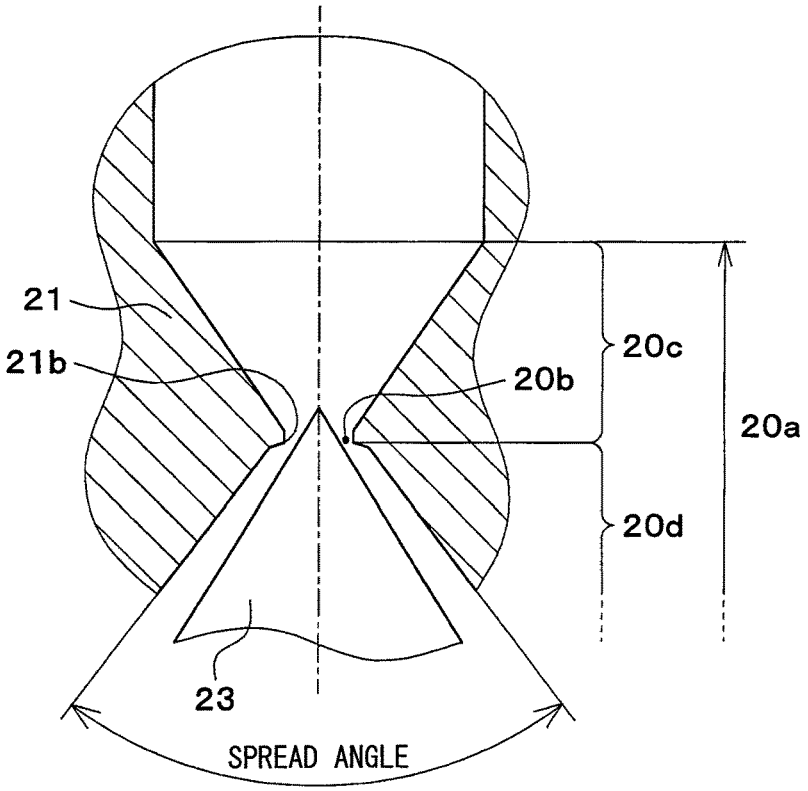
FIG. 8 is an enlarged cross-sectional view schematically illustrating a part of an ejector according to a second embodiment.
Figure 9:
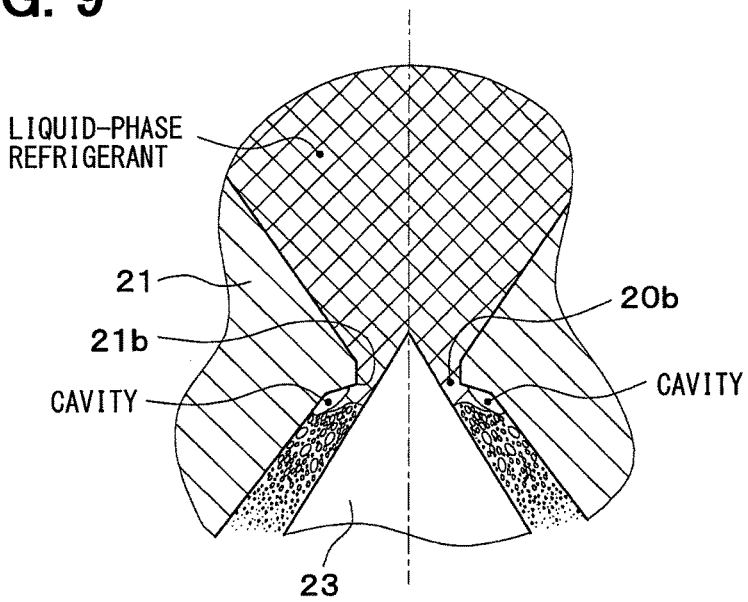
FIG. 9 is an explanatory diagram illustrating how refrigerant boils when the ejector is operated in a low load operation according to the second embodiment.

The present embodiment is different from the first embodiment in that the needle valve 23 does not have the groove 23*b* and the inner wall surface of the nozzle 21 has a different shape as shown in FIG. 8 and FIG. 9. FIG. 8 and FIG. 9 are diagrams corresponding to FIG. 3 and FIG. 7 described in the first embodiment respectively.

Specifically, as shown in FIG. 8, in a cross section including the axis of the nozzle 21, an expansion degree (i.e., a spread angle) of a portion of the nozzle passage 20*a* forming the expansion portion 20*d* changes toward a downstream side in a refrigerant flow direction to be the greatest at a position immediately downstream of the throat portion 21*b* in the refrigerant flow direction.

FIG. 8 shows an example in which the expansion degree of the portion forming the expansion portion 20*d* changes in stages (specifically, in two stages). However, the portion forming the expansion portion 20*d* may have a curved shape in a cross section including the axis of the nozzle 21, such that the expansion degree changes continuously. Other configurations and operations of the ejector 20 and the ejector-type refrigeration cycle 10 are similar to those in the first embodiment.

Therefore, in the ejector-type refrigeration cycle 10 of the present embodiment, it is possible to obtain similar effects to those of the first embodiment. Since the refrigerant swirls in the swirl space 20*e* in the intermediate load operation and the high load operation, the ejector 20 of the present embodiment can exert energy conversion efficiency similarly to that in the first embodiment.

Moreover, according to the ejector 20 of the present embodiment, the expansion degree of the portion forming the expansion portion 20*d* of the nozzle 21 to be the greatest at the position immediately downstream of the throat portion 21*b*. Accordingly, the passage sectional area of the refrigerant passage, through which the refrigerant passes after the minimum sectional area portion 20*b* increases a flow speed of the refrigerant, can be increased drastically at a position immediately downstream of the throat portion 21*b*.

As a result, the refrigerant is decompression boiled and thereby the cavities are generated immediately downstream of the throat portion 21*b* in the nozzle passage 20*a* as shown in FIG. 9. Therefore, the ejector 20 of the present embodiment can exert high energy conversion efficiency even in an operation, e.g., in the low-load operation, in which the refrigerant hardly boils in the swirl space 20*e*, similar to the first embodiment.

In other words, the ejector 20 of the present embodiment can exert the high energy conversion efficiency regardless of load variation in the ejector-type refrigeration cycle 10.

Third Embodiment

Figure 10:
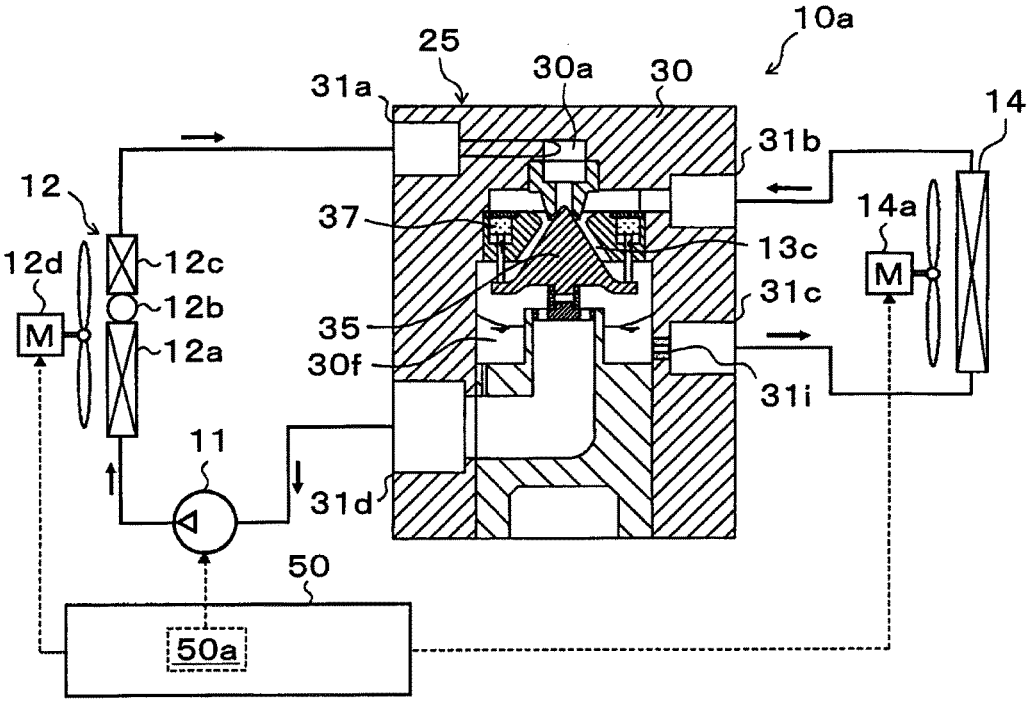
FIG. 10 is a diagram illustrating a whole configuration of an ejector-type refrigeration cycle according to a third embodiment.

The present embodiment is different from the first embodiment in that an ejector 25 is employed in an ejector-type refrigeration cycle 10*a* as shown in an overall configuration diagram in FIG. 10. The ejector 25 is configured by integrating (i.e., modularizing) configurations corresponding to the ejector 20, the gas-liquid separator 13, and the fixed throttle 13*a* described in the first embodiment. Therefore, the ejector 25 can be also described as "an ejector with a gas-liquid separating function" or "an ejector module".

In FIG. 10, illustrations of sensors for air conditioning control such as the evaporator outlet-side temperature sensor 51 and an evaporator outlet-side pressure sensor 52 are omitted for illustration purpose.

A configuration of the ejector 25 will be described in detail with reference to FIG. 11 and FIG. 12. An up-down direction shown in FIG. 11 indicates the up-down direction on a condition that the ejector 25 is disposed in the ejector-type refrigeration cycle 10*a*. FIG. 12 is a schematically enlarged and partially sectional view of part XII of FIG. 11 and is a view corresponding to FIG. 3 in the first embodiment.

Figure 11:
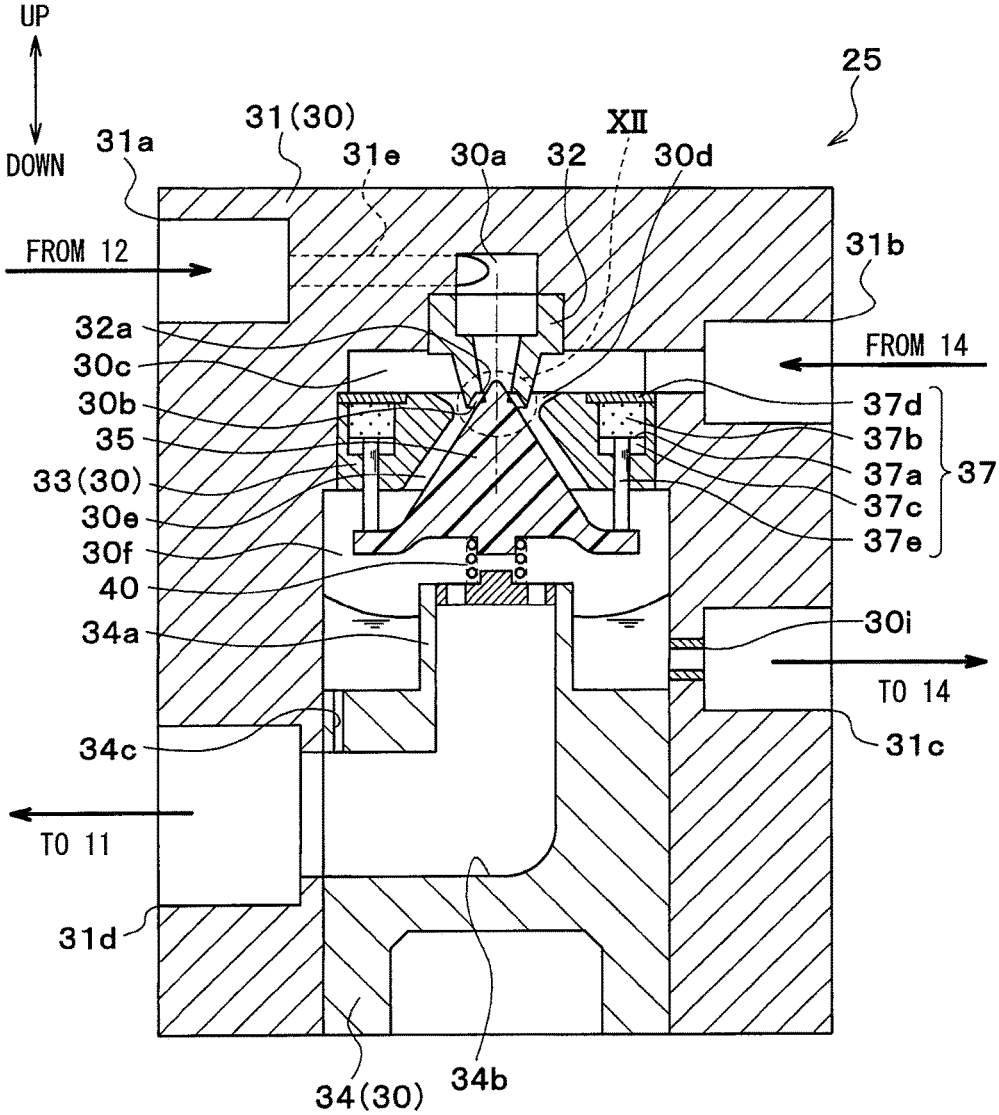
FIG. 11 is a cross-sectional view illustrating an ejector and taken along an axial direction of the ejector, according to the third embodiment.
Figure 12:
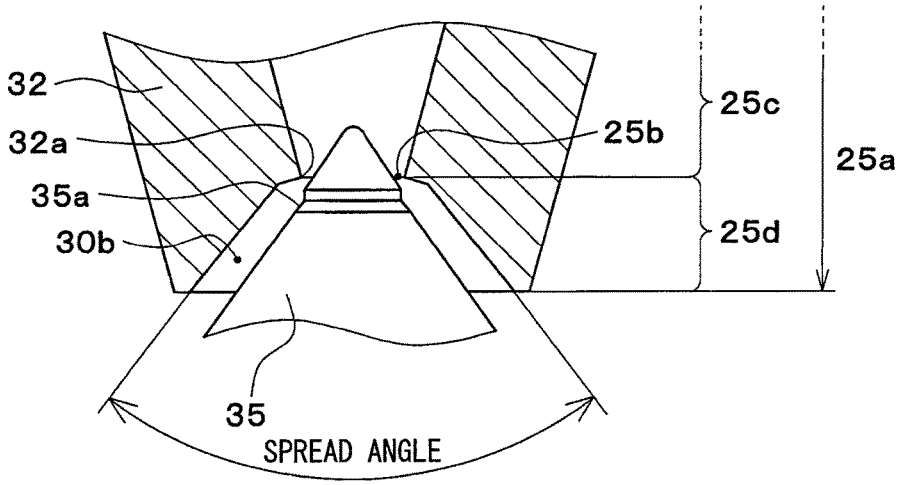
FIG. 12 is an enlarged cross-sectional view illustrating a portion XII shown in FIG. 11.

As shown in FIG. 11, the ejector 25 includes a body 30 configured by assembling component members. Specifically, the body 30 is made of metal or a resin in a prism shape or a columnar shape and includes a housing body 31 providing an outer wall of the ejector 25. A nozzle 32, a middle body 33, a lower body 34, etc. are fixed in the housing body 31.

The housing body 31 is provided with a refrigerant inlet 31*a*, a refrigerant suction port 31*b*, a liquid-phase refrigerant outlet 31*c*, a gas-phase refrigerant outlet 31*d*. The refrigerant inlet 31*a* guides a refrigerant, flowing out of the radiator 12, to flow into the ejector 25. The refrigerant suction port 31*b* draws a refrigerant, flowing out of the evaporator 14, into the ejector 25. The body 30 has a gas-liquid separation space 30*f* therein. The gas-liquid separation space 30*f* separates the refrigerant into a gas-phase refrigerant and a liquid-phase refrigerant. The liquid-phase refrigerant outlet 31*c* guides the liquid-phase refrigerant to flow to the refrigerant inlet of the evaporator 14. The gas-phase refrigerant outlet 31*d* guides the gas-phase refrigerant to flow to the suction port of the compressor 11.

Furthermore, an orifice 31*i* is located in a liquid-phase refrigerant passage according to the present embodiment. The liquid-phase refrigerant passage connects the gas-liquid separation space 30*f* and the liquid-phase refrigerant outlet 31*c* to each other. The orifice 31*i* is a pressure reducer that reduces a pressure of the refrigerant flowing into the evaporator 14. The gas-liquid separation space 30*f* of the present embodiment corresponds to the gas-liquid separator 13 of the first embodiment, and the orifice 31*i* of the present embodiment corresponds to the fixed throttle 13*a* of the first embodiment.

The nozzle 32 of the present embodiment is made of a metal material (e.g., a stainless alloy) in a substantially conical shape tapered in a refrigerant flow direction. Moreover, the nozzle 32 is fixed into the housing body 31 by a method such as press-fitting such that an axial direction of the nozzle 32 coincides with a vertical direction (the up-down direction in FIG. 11). A swirl space 30*a* is defined between an upper portion of the nozzle 32 and the housing body 31. The swirl space 30*a* has a generally columnar shape. The refrigerant flowing from the refrigerant inlet 31*a* swirls in the swirl space 30*a*.

A refrigerant inflow passage 31*e* is defined to connect the refrigerant inlet 31*a* and the swirl space 30*a*. The refrigerant inflow passage 31*e* extends in a tangential direction of an inner wall surface defining the swirl space 30*a* when viewed in an axial direction the swirl space 30*a*. The refrigerant, flowing into the swirl space 30*a* from the refrigerant inflow passage 31*e*, flows along the inner wall surface of the swirl space 30*a* and swirls about a swirl center in the swirl space 30*a*. Therefore, in the present embodiment, a portion forming the swirl space 30*a* of the body 30 and the swirl space 30*a* form a swirl flow generator.

Similar to the first embodiment, dimensions of the swirl space 30*e* etc. are set, such that a refrigerant pressure near the swirl center in the swirl space 20*e* is reduced to a pressure at which the refrigerant becomes a saturated liquid-phase refrigerant in the intermediate-load operation and in the high-load operation. Alternatively, the dimensions of the swirl space 20*e* etc. are set, such that the refrigerant pressure near the swirl center in the swirl space 20*e* is reduced to a pressure at which the refrigerant is decompression-boiled in the intermediate-load operation and in the high-load operation. In the intermediate-load operation, a thermal load in the ejector-type refrigeration cycle 10*a* is an intermediate value. In the high-load operation, the thermal load is a relatively high load.

A pressure reducing space 30*b* is defined inside the nozzle 32. The pressure reducing space 30*b* reduces the pressure of the refrigerant flowing out of the swirl space 30*a* and guides the refrigerant to flow out of the pressure reducing space 30*b* toward a downstream side. The pressure reducing space 30*b* is defined by a revolution and has a columnar space and a truncated cone space connected to each other. The truncated cone space has a sectional area increasing gradually from a lower side of the columnar space in the refrigerant flow direction. A central axis of the pressure reducing space 30*b* is disposed coaxially with the central axis of the swirl space 30*a*.

A passage defining member 35 is located in the pressure reducing space 30*b*. The passage defining member 35 performs a similar function to that of the needle valve 23 described in the first embodiment. Specifically, the passage defining member 35 is made from a resin similar to the resin from which the needle valve 23 is made. The passage defining member 35 has a conical shape, and a sectional area of the passage defining member 35 increases as being away from the pressure reducing space 30*b*. The passage defining member 35 is positioned to be coaxially with the pressure reducing space 30*b*.

Accordingly, at least a part of a nozzle passage 25*a* is defined between an inner surface of the nozzle 32 defining the pressure reducing space 30*b* and an outer surface of the passage defining member 35 as shown in FIG. 12. The nozzle passage 25*a* has an annular shape in cross section and reduces the pressure of the refrigerant.

The nozzle 32 has an inner wall surface defining a throat portion 32*a*. The throat portion 32*a* defines a minimum sectional are portion 25*b* (i.e., the smallest passage sectional area portion) that has a smallest sectional area all over the refrigerant passage defined in the nozzle 32. The nozzle passage 25*a* has a tapered portion 25*c* and an expansion portion 25*d*. The tapered portion 25*c* is located on an upstream side of the minimum sectional area portion 25*b* in the refrigerant flow direction and has a passage sectional area decreasing toward the minimum sectional area portion 25*b* gradually. The expansion portion 25*d* is located on a downstream side of the minimum sectional area portion 25*b* in the refrigerant flow direction and has a passage sectional area gradually increasing as the expansion portion 25*d* extends away from the minimum sectional area portion 25*b*.

Therefore, in the nozzle passage 25*a* of the present embodiment, the sectional area of the refrigerant passage changes similarly to a rubber nozzle. Moreover, according to the present embodiment, the sectional area of the nozzle passage 25*a* is changed such that a flow speed of the injection refrigerant jetting out of the nozzle passage 25*a* becomes the sound speed or higher in a normal operation of the ejector-type refrigeration cycle 10*a*.

As shown in FIG. 12, the passage defining member 35 has an end portion on a side adjacent to the nozzle passage 25*a*, and the end portion is provided with a groove 35*a*. The groove 35*a* extends over an entire circumference of the end portion in a circumferential direction centering the axis of the nozzle 32. The groove 35*a* is recessed in such a direction as to increase the passage sectional area of the nozzle passage 25*a*. The groove 35*a* is capable of being located immediately downstream of the minimum sectional area portion 25*b* by moving the passage defining member 35.

Moreover, in a cross section including the axis of the nozzle 32, the inner surface of the nozzle 32 of the present embodiment is defined such that an expansion degree of a portion forming the expansion portion 25*d* in the nozzle passage 25*a* changes toward a downstream side in the refrigerant flow direction as shown in FIG. 12. Specifically, similarly to the second embodiment, the expansion degree becomes the greatest at a position immediately downstream of the throat portion 32*a*.

The middle body 33 shown in FIG. 11 is made of metal and has a columnar shape. The middle body 33 has a through hole that passes through the middle body 33 from one surface to another surface facing each other (in the up-down direction). A drive mechanism 37 is positioned between an outer surface of the middle body 33 and the through hole in a radial direction of the middle body 33. The drive mechanism 37 is a drive portion that moves the passage defining member 35. T The middle body 33 is fixed by a method such as press fitting on a lower side of the nozzle 32 in the housing body 31.

An inflow space 30*c* is defined between an upper surface of the middle body 33 and an inner wall surface of the housing body 31 facing the upper surface of the middle body 33. The refrigerant flowing into the ejector 25 from the refrigerant suction port 31*b* is stored in the inflow space 30*c*. A suction passage 30*d* is defined between an inner surface of the through hole defined in the middle body 33 and an outer surface of a lower portion of the nozzle 32. The suction passage 30*d* connects the inflow space 30*c* and a downstream end of the pressure reducing space 30*b* to each other.

The through hole of the middle body 33 has a pressure increasing space 30*e* on a downstream side of the suction passage 30*d* in the refrigerant flow direction. The pressure increasing space 30*e* has a substantially truncated cone shape of which sectional area increases in the refrigerant flow direction gradually. The pressure increasing space 30*e* is a space in which the injection refrigerant injected by the nozzle passage 25*a* and the suction refrigerant drawn by the suction passage 30*d* are mixed. The pressure increasing space 30*e* is positioned to be coaxially with both of the swirl space 30*a* and the pressure reducing space 30*b*.

A lower portion of the passage defining member 35 is located in the pressure increasing space 30*e*. The pressure increasing space 30*e* is defined by an inner surface of the middle body 33, and a refrigerant passage is defined between the inner surface of the middle body 33 and the outer surface of the lower portion of the passage defining member 35. The refrigerant passage has a passage sectional area increasing toward the downstream side in the refrigerant flow direction gradually. As a result, velocity energy of the injection refrigerant and the suction refrigerant can be converted into pressure energy in the refrigerant passage.

Therefore, the refrigerant passage, which is defined between the inner surface of the middle body 33 defining the pressure increasing space 30*e* and the outer surface of the lower portion of the passage defining member 35, configures a diffuser passage. The diffuser passage serves as a diffuser (i.e., the pressure increasing portion) in which the injection refrigerant and the suction refrigerant are mixed and which increases a pressure of the mixed refrigerant.

The drive mechanism 37 located inside the middle body 33 will be described hereafter. The drive mechanism 37 has a diaphragm 37*a*. The diaphragm 37*a* is a pressure responsive member and has a circular thin plate shape. More specifically, the middle body 33 therein has a columnar hollow located adjacent to the outer surface of the middle body 33. The diaphragm 37*a* is fixed in the columnar hollow by a method such as welding and partitions the columnar hollow into an upper space and a lower space.

The upper space is located on a side adjacent to the inflow space 30*c* and provides a closed space 37*b*. The closed space 37*b* is filled with a thermosensitive medium. A pressure of the thermosensitive medium varies depending on a temperature of the refrigerant at an outlet of the evaporator 14, i.e., a temperature of the refrigerant flowing out of the evaporator 14. The thermosensitive medium contains the refrigerant, which is the same refrigerant circulating in the ejector-type refrigeration cycle 10*a*, as a base. The thermosensitive medium is packed in the closed space 37*b* such that a density of the thermosensitive medium becomes a specified value.

The lower space partitioned by the diaphragm 37*a* configures an introducing space 37*c*. The introducing space 37*c* guides the refrigerant to flow from the evaporator 14 into the ejector 25 through a passage (not shown). Accordingly, a temperature of the refrigerant flowing out of the evaporator 14 is transmitted to the thermosensitive medium packed in the closed space 37*b* through a sealing member 37*d*, which partitions the inflow space 30*c* and the closed space 37*b*, and the diaphragm 37*a*.

The diaphragm 37*a* deforms depending on a pressure difference between an inner pressure of the closed space 37*b* and a pressure of the refrigerant flowing from the evaporator 14 into the introducing space 37*c*. Accordingly, the diaphragm 37*a* is preferably made of a material that has a great elasticity, great thermal conductivity, and great toughness. For example, the diaphragm 37*a* may be configured by a metal thin plate made of stainless steel (e.g., SUS304) or EPDM (ethylene propylene diene copolymer rubber) including base fabric.

The drive mechanism 37 has an actuation rod 37*e*. The actuation rod 37*e* has a columnar shape and has one end and the other end facing each other in the up-down direction. The one end (i.e., an upper end) of the actuation rod 37*e* is attached to a center portion of the diaphragm 37*a*. The actuation rod 37*e* transmits drive force from the drive mechanism 37 to the passage defining member 35 to move the passage defining member 35. The other end (i.e., a lower end) of the actuation rod 37*e* abuts on a surface of a radial outer portion of the passage defining member 35. The radial outer portion is located on a bottom side in the passage defining member 35.

As shown in FIG. 11, a coil spring 40 applies a load to a bottom surface of the passage defining member 35. The coil spring 40 is an elastic member that applies the load to bias the passage defining member 35 upward. "Upward" means "in a direction in which the passage defining member 35 decreases a sectional area of the minimum sectional area portion 25*b*". Therefore, the passage defining member 35 is moved so as to balance a load received from the high-pressure refrigerant on a side adjacent to the swirl space 30*a*, a load received from the low-pressure refrigerant on a side adjacent to the gas-liquid separation space 30*f*, loads received from the actuating rods 37*e*, and the load from the coil spring 40.

Specifically, when the temperature (i.e., the superheat degree) of the refrigerant on the outlet side of the evaporator 14 increases, a saturation pressure of the thermosensitive medium packed in the closed space 37*b* increases, and thereby a pressure difference calculated by subtracting the pressure of the introducing space 37*c* from the internal pressure of the closed space 37*b* becomes large. As a result, the diaphragm 37*a* moves toward the introducing spaces 37*c*, and thereby the load, which is transmitted from the actuation rod 37*e* to the passage defining member 35, increases. Therefore, when the temperature of the refrigerant on the outlet side of the evaporator 14 increases, the passage defining member 35 moves in such a direction as to increase the passage sectional area of the minimum sectional area portion 25*b* (i.e., downward in the vertical direction).

On the other hand, when the temperature (i.e., the superheat degree) of the refrigerant on the outlet side of the evaporator 14 falls, the saturation pressure of the thermosensitive medium packed in the closed space 37*b* falls, and thereby the pressure difference calculated by subtracting the pressure of the introducing space 37*c* from the internal pressure of the closed space 37*b* becomes small. As a result, the diaphragm 37*a* moves toward the closed spaces 37*b*, and thereby the load, which is transmitted from the actuation rod 37*e* to the passage defining member 35, decreases. Therefore, when the temperature of the refrigerant on the outlet side of the evaporator 14 falls, the passage defining member 35 moves in such a direction as to reduce the passage sectional area of the minimum sectional area portion 25*b* (i.e., upward in the vertical direction).

The drive mechanism 37 of the present embodiment adjusts the passage sectional area of the minimum sectional area portion 25*b* such that the superheat degree of the refrigerant on the outlet side of the evaporator 14 approaches the reference superheat degree KSH, in a manner that the diaphragm 37*a* moves the passage defining member 35 depending on the superheat degree of the refrigerant on the outlet side of the evaporator 14. The reference superheat degree KSH can be changed by adjusting the load of the coil spring 40.

Although a void may be defined between the actuation rod 37*e* and the middle body, the void is sealed by a sealing member such as an O-ring (not shown), thereby the refrigerant does not leak through the void even when the actuation rod 37*e* moves.

According to the present embodiment, the middle body 33 is provided with more than one columnar hollow. Specifically, a quantity of the columnar hollows is three according to the present embodiment. The diaphragm 37*a* is fixed in each of the columnar hollows, thereby more than one drive mechanism 37 is provided. The drive mechanisms 37 are positioned at regular intervals and at equal angles around a central axis. As a result, the drive forces applied from the drive mechanisms 37 to the passage defining member 35 become equal to each other.

The lower body 34 is configured by a columnar metal member and fixed in the housing body 31 by a method such as screwing so as to close a bottom surface of the housing body 31. The gas-liquid separation space 30*f* is defined between an upper portion of the lower body 34 and the middle body 33. The gas-liquid separation space 30*f* separates the refrigerant, which flows from the diffuser passage defined in the pressure increasing space 30*e*, into the gas-phase refrigerant and the liquid-phase refrigerant.

The gas-liquid separation space 30*f* is defined as an inside of a revolution and has a substantially columnar shape. The gas-liquid separation space 30*f* is positioned coaxially with the swirl space 30*a*, the pressure reducing space 30*b*, and the pressure increasing space 30*e*. The refrigerant receives centrifugal force while swirling about the swirl center in the gas-liquid separation space 30*f*, and thereby being separated into the gas-phase refrigerant and the liquid-phase refrigerant. Moreover, an inner capacity of the gas-liquid separation space 30*f* is set to such a capacity as to be able to store substantially no excess refrigerant even when load variation occurs in the cycle and the volume of the refrigerant circulating in the cycle changes.

A pipe 34*a* is disposed in a center portion of the lower body 34. The pipe 34*a* is positioned coaxially with the gas-liquid separation space 30*f* and extends upward from the lower body 34. The liquid-phase refrigerant separated in the gas-liquid separation space 30*f* is stored on a radial outer side of the pipe 34*a* temporary, and then flows out from the liquid-phase refrigerant outlet 31*c*. The pipe 34*a* defines a gas-phase refrigerant outflow passage 34*b* therein. The gas-phase refrigerant outflow passage 34*b* guides the gas-phase refrigerant, separated in the gas-liquid separation space 30*f*, to the gas-phase refrigerant outlet 31*d* of the housing body 31.

The above-described coil spring 40 is fixed to an upper end portion of the pipe 34*a*. The coil spring 40 also functions as a vibration damping member that damps vibrations of the passage defining member 35 caused by pressure pulsation occurring when a pressure of the refrigerant falls. A bottom surface, which defines a bottom of the gas-liquid separation space 30*f*, is provided with an oil return hole 34*c*. A refrigerant oil included in the liquid-phase refrigerant flows out of the gas-liquid separation space 30*f* from the oil return hole 34*c* and returns into the compressor 11 through the gas-phase refrigerant outflow passage 34*b*.

Therefore, the ejector 25 of the present embodiment can be described as follows.

The ejector 25 of the present embodiment includes the body (30), the passage defining member (35), and the drive portion (37).

The body (30) has the pressure reducing space (30*b*), the suction passages (30*c*, 30*d*), and the pressure increasing space (30*e*). The pressure reducing space (30*b*) reduces the pressure of the refrigerant flowing from the refrigerant inlet (31*a*). The suction passages (30*c*, 30*d*) communicate with the downstream end of the pressure reducing space (30*b*) in the refrigerant flow direction and allow the refrigerant drawn from outside into the ejector. The pressure increasing space (30*e*) mixes the injection refrigerant jetting out of the pressure reducing space (30*b*) and the suction refrigerant drawn from the suction passages (30*c*, 30*d*).

At least a part of the passage defining member (35) is located in the pressure reducing space (30*b*) and the pressure increasing space (30*e*). The passage defining member (35) has the conical shape of which sectional area increases as being away from the pressure reducing space (30*b*). The drive portion (37) outputs the drive force that moves the passage defining member (35).

The refrigerant passage, which is defined between the inner surface of the portion forming the pressure reducing space (30*b*) in the body (30) and the outer surface of the passage defining member (35), is the nozzle passage (25*a*) functioning as the nozzle that reduces the pressure of the refrigerant flowing from the refrigerant inlet (31*a*) and injects the refrigerant. In other words, the nozzle passage (25*a*) functioning as the nozzle, which reduces the pressure of the refrigerant flowing from the refrigerant inlet (31*a*) and injects the refrigerant, is defined between the inner surface of the portion forming the pressure reducing space (30*b*) in the body (30) and the outer surface of the passage defining member (35).

The refrigerant passage, which is defined between the inner surface of the portion defining the pressure increasing space (30*e*) in the body (30) and the outer surface of the passage defining member (35), is the diffuser passage functioning as the pressure increasing portion that mixes the injection refrigerant and the suction refrigerant and increases the pressure of the mixed refrigerant. In other words, the diffuser passage, which functions as the pressure increasing portion that mixes the injection refrigerant and the suction refrigerant and that increases the pressure of the mixed refrigerant, is defined between the inner surface of the portion defining the pressure increasing space (30*e*) in the body (30) and the outer peripheral face of the passage defining member (35).

The nozzle passage (25*a*) has the minimum sectional area portion (25*b*), the tapered portion (25*c*), and the expansion portion (25*d*). The minimum sectional area portion (25*b*) is the portion of the nozzle passage (25*a*) having the smallest passage sectional area. The tapered portion (25*c*) is located on the upstream side of the minimum sectional area portion (25*b*) in the refrigerant flow direction and has the passage sectional area gradually reducing toward the minimum sectional area portion (25*b*). The expansion portion (25*d*) is located on the downstream side of the minimum sectional area portion (25*b*) in the refrigerant flow direction and has the gradually increasing passage sectional area.

The passage defining member (35) has the groove (35*a*). The groove (35*a*) extends over the entire circumference of the nozzle (21). The groove (35*a*) is recessed in such a direction as to increase the passage sectional area of the nozzle passage (25*a*). The drive portion (37) moves the passage defining member (35), such that the groove (35*a*) is positioned immediately downstream of the minimum sectional area portion (25*b*) in the refrigerant flow direction when viewed in the direction perpendicular to the axial direction of the nozzle (32).

In the cross section including the axis of the nozzle (32), the expansion degree of the portion defining the expansion portion (25*d*) in the nozzle (32) changes toward the downstream side of the refrigerant flow. The expansion degree is the greatest at the position immediately downstream of the throat portion (32*a*) that defines the minimum sectional area portion (25*b*).

Other configurations of the ejector-type refrigeration cycle 10*a* are similar to those of the ejector-type refrigeration cycle 10 of the first embodiment. Here, the ejector 25 of the present embodiment is configured by integrating the component devices included in the cycle. Therefore, when the ejector-type refrigeration cycle 10*a* of the present embodiment operates, the ejector-type refrigeration cycle 10*a* operates similarly to the ejector-type refrigeration cycle 10 of the first embodiment and similar effects can be obtained.

The ejector 25 of the present embodiment has the swirl space 30*a* as the swirl flow generator. As a result, the ejector 25 can exert high energy conversion efficiency as in the first embodiment, in a manner that the refrigerant swirls in the swirl space 30*a* in the intermediate load operation and the high load operation of the ejector-type refrigerant cycle 10*a*.

In the ejector 25 of the present embodiment, the drive mechanism 37 moves the passage defining member 35 in such a direction as to reduce the passage sectional area of the minimum sectional area portion 25*b*, such that the superheat degree SH of the refrigerant on the outlet side of the evaporator 14 approaches to the reference superheat degree KSH in the low load operation in which the volume of the refrigerant circulating in the cycle is reduced.

Accordingly, in the low load operation, the groove 35*a* provided with the passage defining member 35 is capable of being positioned immediately downstream of the minimum sectional area portion 25*b* of the nozzle passage 25*a* in the refrigerant flow direction. Therefore, the groove 35*a* can increase the passage sectional area of the refrigerant passage, in which the refrigerant flows after the minimum sectional area portion 25*b* decreases the flow speed of the refrigerant, drastically.

Accordingly, the cavities can be generated in the groove 35*a* similar to the first embodiment. As a result, the ejector 25 can exert the high energy conversion efficiency similar to the first embodiment even in the operation in which the refrigerant is hardly decompression-boiled in the swirl space 30*a*.

In addition, according to the ejector 25 of the present embodiment, the portion of the nozzle 32 defining the expansion portion 25*d* has the largest expansion degree at the position immediately downstream of the throat portion 32*a*. As a result, the passage sectional area, in which the refrigerant flows after the minimum sectional area portion 25*b* increases the flow speed of the refrigerant, can be increased drastically at the position immediately downstream of the throat portion 32*a*.

Therefore, similar to the second embodiment, the cavities can be generated at the position immediately downstream of the throat portion 21*b* in the nozzle passage 25*a*. Thus, similar to the first embodiment, the ejector 25 can exert the high energy conversion efficiency even in the operation in which the refrigerant is hardly decompression-boiled in the swirl space 30*a*.

In other words, the ejector 25 of the present embodiment can exert the high energy conversion efficiency regardless of the load variation in the ejector-type refrigeration cycle 10.

Fourth Embodiment

Figure 13:
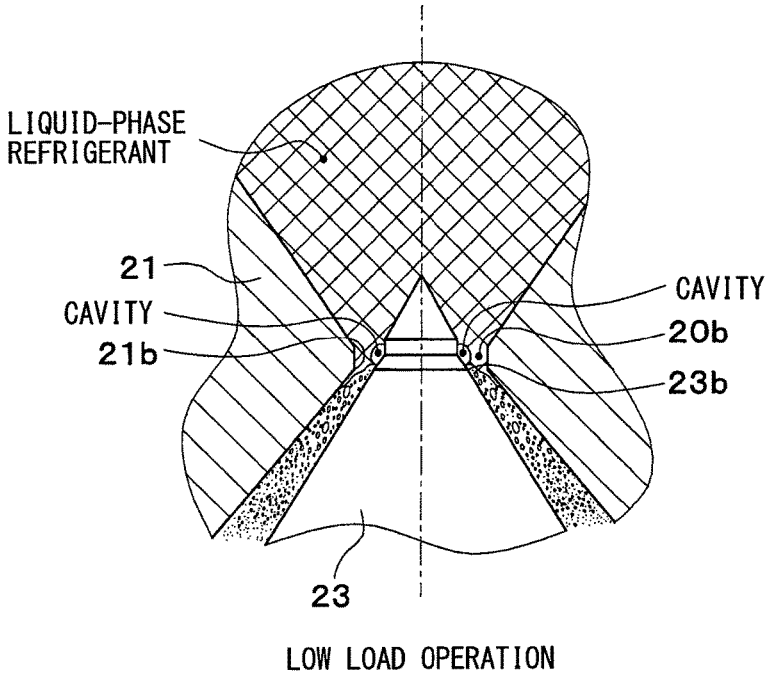
FIG. 13 is an explanatory diagram illustrating how refrigerant boils when an ejector is operated in a low load operation according to a fourth embodiment.

The present embodiment is different from the first embodiment in that the groove 23*b* in the needle valve 23 is disposed on an upstream side of a minimum sectional area portion 20*b* of the nozzle passage 20*a* in a refrigerant flow direction during low load operation as shown in FIG. 13. FIG. 13 is a view corresponding to FIG. 7 described in the first embodiment. Other configurations and operation of the ejector 20 and the ejector-type refrigeration cycle 10 are similar to those in the first embodiment.

Even when the groove 23*b* is provided as in the present embodiment, the cavities can be generated in the groove 23*b* in the low load operation. Therefore, the ejector 20 of the present embodiment can exert high energy conversion efficiency in the low load operation similarly to the first embodiment. Moreover, the groove 23*b* may be positioned upstream of the minimum sectional area portion 20*b* in the refrigerant flow direction in high load operation.

Fifth Embodiment

Figure 14:
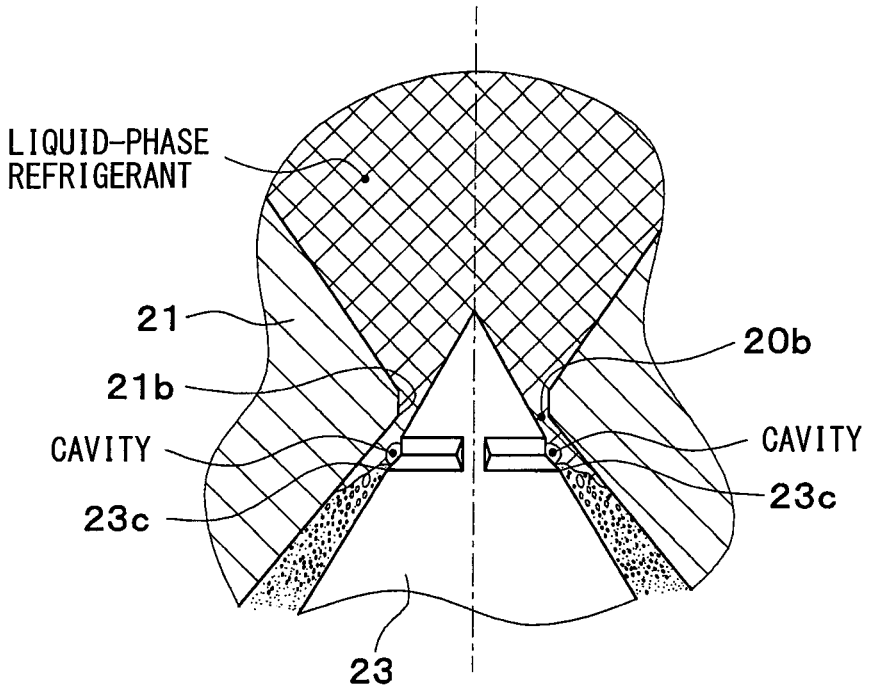
FIG. 14 is an explanatory diagram illustrating how refrigerant boils when an ejector is operated in a low load operation according to a fifth embodiment.

The present embodiment is different from the first embodiment in that the groove 23*b* does not extend continuously over an entire circumference of a needle valve in the circumferential direction centering the axis. Instead, two or more grooves 23*c* are arranged annularly at equal angles around the axis as shown in FIG. 14. Specifically, the two grooves 23*c* are arranged in a circle. Each of the two grooves 23*c* has a semicircular shape when viewed in an axial direction.

FIG. 14 is a view corresponding to FIG. 7 described in the first embodiment. Other configurations and operation of the ejector 20 and the ejector-type refrigeration cycle 10 are similar to those in the first embodiment.

Even when the groove 23*b* is provided as in the present embodiment, the cavities can be generated in the groove 23*b* in the low load operation. Therefore, the ejector 20 of the present embodiment can exert high energy conversion efficiency in the low load operation similarly to the first embodiment. Moreover, as a modification of the present embodiment, the grooves 23*c* may be positioned upstream of the minimum sectional area portion 20*b* in a refrigerant flow direction, similarly to the fourth embodiment.

MODIFICATIONS

It should be understood that the present disclosure is not limited to the above-described embodiments and intended to cover various modification within a scope of the present disclosure as described hereafter. It should be understood that structures described in the above-described embodiments are preferred structures, and the present disclosure is not limited to have the preferred structures. The scope of the present disclosure includes all modifications that are equivalent to descriptions of the present disclosure or that are made within the scope of the present disclosure.

(1) Although the needle valve 23 and the passage defining member 35 are made of the thermoplastic resin in the above-described embodiments, it is needless to say that the needle valve 23 and the passage defining member 35 may be made of metal. Even when the needle valve 23 and the passage defining member 35 are made of metal, the groove 23*b* and the groove 35*a* may be formed by pushing the needle valve 23 and the passage defining member 35 against the nozzle 21 or the nozzle 32 in the forming of the groove.

In this case, the needle valve 23 and the passage defining member 35 is preferably made of metal (e.g., aluminum) that is softer than a stainless alloy forming the nozzle 21 and the nozzle 32.

(2) The features disclosed in the above-described embodiments may be combined suitably as far as the combination is feasible. For example, the expansion portion 20*d* provided with the nozzle 21 of the ejector 20 described in the first embodiment may have such a shape that an expansion degree is the greatest at a position immediately downstream of the throat portion 21*b* as described in the second embodiment.

In the ejector 25 described in the third embodiment, the groove 35*a* may not be provided in the passage defining member 35. The expansion degree of the portion located immediately downstream of the throat portion 32*a* may be constant. The groove 23*b* or the groove 23*c* may be arranged in the ejector 25 of the third embodiment at the same positions as described in the fourth embodiment and the fifth embodiment respectively. As a modification, two or more grooves 23*b* having a similar annular shape as that in the first embodiment may be arranged in the axial direction.

The grooves 23*b*, 35*a* provided with the passage defining member and the expansion portions 20*d*, 25*d* of the nozzle 21, 32, which have the shape having the largest expansion degree at the position immediately downstream of the throat portions 21*b*, 32*a* respectively, may be employed instead of the swirl flow generator (i.e., the swirl space 29*e*, the cylindrical portion 21*d*, and the swirl space 30*a*) not in addition to the swirl flow generator.

When the swirl generator is omitted, the boiling of the refrigerant can be facilitated effectively in a manner that the groove 23*b* is positioned upstream of the minimum sectional area portion 20*b* in the refrigerant flow direction as described in the fourth embodiment.

(3) The devices configuring the ejector-type refrigeration cycle 10 are not limited to those disclosed in the above-described embodiments.

For example, the compressor 11 is the electric compressor according to the above-described embodiments. However, the compressor 11 may be an engine-driven compressor that is driven by a rotary drive force transmitted from an engine for traveling of a vehicle via a pulley, a belt, and the like. Furthermore, the engine-driven compressor may be a variable-capacity compressor of which refrigerant discharge capacity is adjustable by changing a volume of the refrigerant discharged by the variable compressor. Alternatively, the engine-driven compressor may be a fixed-capacity compressor of which refrigerant discharge capacity is adjusted in a manner that an operation rate of the compressor is changed by engaging and throwing out an electromagnetic clutch.

Although the subcool heat exchanger is employed as the radiator 12 according to the above-described embodiments, a normal radiator configured only by the condensing portion 12*a* may be employed. Moreover, a receiver-integrated condenser may be employed in addition to the normal radiator. The receiver-integrated condenser includes a liquid receiver (i.e., a reservoir) that separates refrigerant, after dissipating heat in the radiator, into gas-phase refrigerant and liquid-phase refrigerant and stores excess liquid-phase refrigerant The refrigerant is R134a or R1234yf according to the above-described embodiments, however may be R600a, R410A, R404A, R32, R407C, HFO-1234ze, HFO-1234zd, etc. Alternatively, the refrigerant may be a mixed refrigerant of two or more kinds of R134a, R1234yf, R600a, R410A, R404A, R32, R407C, HFO-1234ze, and HFO-1234zd.

(4) The ejector-type refrigeration cycle 10 of the present disclosure is disposed in the vehicle air conditioner according to the above-described embodiments. However, the ejector-type refrigeration cycle 10 of the present disclosure is not limited to be disposed in the vehicle air conditioner. For example, the ejector-type refrigeration cycle 10 may be disposed in a stationary air conditioner, a cool storage, a cooling and heating device for a vending machine, or the like.

According to the above-described embodiments, the radiator 12 of the ejector-type refrigeration cycle 10 according to the present disclosure is used as an exterior-side heat exchanger that exchange heat between the refrigerant and the outside air, and the evaporator 14 is used as a utilization-side heat exchanger for cooling the air. However, the evaporator 14 may be used as an exterior-side heat exchanger that absorb heat from a heat source such as outside air, and the radiator 12 may be used as an interior-side heat exchanger that heats fluid to be heated such as air and water to form a heat pump cycle.

The invention claimed is:

1. An ejector for a vapor compression refrigeration cycle device, the ejector comprising:

a nozzle that jets a refrigerant as an injection refrigerant;

a body having a refrigerant suction port that draws a refrigerant, as a suction refrigerant, from outside using a suction force of the injection refrigerant jetting out of the nozzle and a pressure increasing portion that mixes the injection refrigerant and the suction refrigerant to be a mixed refrigerant and increases a pressure of the mixed refrigerant;

a passage defining member that is located in a refrigerant passage, the refrigerant passage being defined in the nozzle; and a drive portion that moves the passage defining member, wherein the refrigerant passage has a nozzle passage defined between an inner surface of the nozzle and an outer surface of the passage defining member, the nozzle passage has a minimum sectional area portion that has a smallest passage sectional area in the nozzle passage, a tapered portion that is located on an upstream side of the minimum sectional area portion in a refrigerant flow direction, the tapered portion having a passage sectional area decreasing toward the minimum sectional area portion gradually, and an expansion portion that is located on a downstream side of the minimum sectional area portion in the refrigerant flow direction, the expansion portion having a passage sectional area increasing gradually, and the passage defining member has a groove that is recessed to increase the passage sectional area of the nozzle passage.

2. The ejector according to claim 1, wherein the groove extends over an entire circumference of the nozzle in a circumferential direction centering an axis of the nozzle.

3. The ejector according to claim 1, wherein the groove is located at a position where a liquid-phase refrigerant flowing into the nozzle passage starts boiling.

4. The ejector according to claim 1, wherein the drive portion is configured to move the passage defining member so as to locate the groove immediately downstream of the minimum sectional area portion in the refrigerant flow direction when viewed in a direction perpendicular to an axial direction of the nozzle.

5. The ejector according to claim 1, wherein the inner surface of the nozzle and the outer surface of the passage defining member are in surface contact with each other when the drive portion locates the passage defining member to be in contact with the nozzle.

6. The ejector according to claim 1, wherein the nozzle has a portion that defines the expansion portion, an expansion degree of the portion of the nozzle changes toward the downstream side in the refrigerant flow direction in a cross section including the axis of the nozzle, and the expansion degree is a greatest at a position immediately downstream of a throat portion, the throat portion defining the minimum sectional area portion.

7. The ejector according to claim 1, further comprising a swirl flow generator that causes the refrigerant flowing into the nozzle to swirl around an axis of the nozzle.

8. An ejector-type refrigeration cycle comprising:

the ejector according to claim 7;

a compressor that compresses a refrigerant to be a high-pressure refrigerant and discharges the high-pressure refrigerant; and a radiator that cools the high-pressure refrigerant from the compressor until the high-pressure refrigerant becomes a subcooled liquid-phase refrigerant, wherein the subcooled liquid-phase refrigerant flows into the swirl flow generator.

9. A manufacturing method for the ejector according to claim 1, the manufacturing method comprising forming the groove by pushing the passage defining member against the nozzle.

10. The manufacturing method for the ejector according claim 9, wherein the passage defining member is made of a resin, and the passage defining member is heated before being pushed against the nozzle when forming the groove.

11. An ejector for a vapor compression refrigeration cycle device, the ejector comprising:

a nozzle that jets a refrigerant as an injection refrigerant;

a body having a refrigerant suction port that draws a refrigerant, as a suction refrigerant, from outside using a suction force of the injection refrigerant jetting out of the nozzle and a pressure increasing portion that mixes the injection refrigerant and the suction refrigerant to be a mixed refrigerant and increases a pressure of the mixed refrigerant;

a passage defining member that is located in a refrigerant passage, the refrigerant passage being defined in the nozzle; and a drive portion that moves the passage defining member, wherein the refrigerant passage has a nozzle passage defined between an inner surface of the nozzle and an outer surface of the passage defining member, the nozzle passage has an annular shape in a cross section perpendicular to an axial direction of the nozzle, the nozzle passage has a minimum sectional area portion that has a smallest passage sectional area in the nozzle passage, a tapered portion that is located on an upstream side of the minimum sectional area portion in a refrigerant flow direction, the tapered portion having a passage sectional area decreasing toward the minimum sectional area portion gradually, and an expansion portion that is located on a downstream side of the minimum sectional area portion in the refrigerant flow direction, the expansion portion having a passage sectional area increasing gradually, the nozzle has a portion that defines the expansion portion, an expansion degree of the portion of the nozzle changes toward the downstream side in the refrigerant flow direction in a cross section including an axis of the nozzle, the expansion degree is a greatest at a position immediately downstream of a throat portion, the throat portion defining the minimum sectional area portion, and the passage defining member has a groove that is recessed to increase the passage sectional area of the nozzle passage.

* * * * *